US008695134B2

(12) United States Patent
Schultz

(10) Patent No.: US 8,695,134 B2
(45) **Date of Patent: *Apr. 15, 2014**

(54) SLEEP SYSTEM

(75) Inventor: John Schultz, Seattle, WA (US)

(73) Assignee: Squire Sleep Systems LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/549,200

(22) Filed: Jul. 13, 2012

(65) Prior Publication Data

US 2012/0272452 A1 Nov. 1, 2012

Related U.S. Application Data

(63) Continuation of application No. 12/765,718, filed on Apr. 22, 2010, now Pat. No. 8,220,091, and a continuation-in-part of application No. 12/755,172, filed on Apr. 6, 2010, now Pat. No. 8,234,735, which is a continuation of application No. 12/470,741, filed on May 22, 2009, now Pat. No. 7,698,766, which is a continuation of application No. 12/020,363, filed on Jan. 25, 2008, now Pat. No. 7,536,741.

(60) Provisional application No. 61/214,389, filed on Apr. 22, 2009.

(51) Int. Cl.
*A47C 27/14* (2006.01)
*A47C 20/02* (2006.01)

(52) U.S. Cl.
USPC ..... 5/638; 5/731; 5/734; 5/722; 5/632

(58) Field of Classification Search
USPC ..... 5/731–735, 724, 694, 646, 631, 632
See application file for complete search history.

(56) References Cited

U.S. PATENT DOCUMENTS

| | | | |
|---|---|---|---|
| 254,759 | A | 3/1882 | Young |
| 433,905 | A | 8/1890 | Muller |
| 929,449 | A | 7/1909 | Klimowicz et al. |
| 1,548,728 | A | 8/1925 | Milam |
| 2,182,861 | A | 12/1939 | Albert |
| 2,550,293 | A | 4/1951 | Platis |
| 3,608,103 | A | 9/1971 | Seid |
| 3,747,916 | A | 7/1973 | Benson |
| 3,808,615 | A | 5/1974 | Geary |

(Continued)

OTHER PUBLICATIONS

Stephanie Zinser, "Can this 'superbed' give you the perfect sleep?", Daily Mail, Good Health / Innovations, Aug. 17, 1999, p. 35.

(Continued)

*Primary Examiner* — Michael Trettel
(74) *Attorney, Agent, or Firm* — Lowe Graham Jones PLLC

(57) ABSTRACT

An apparatus for facilitating sleep is disclosed. Embodiments of the sleep system receive a person's lower arm in an arm cavity of a person laying in a sleep-on-side position. An exemplary sleep system has a trunk rest and head rest. Two separated cantilevered supports extending outwardly from the base portion of the head rest are in contact with and supported by a top edge of the trunk rest, thereby defining an arm aperture that receives the person's lower arm when laying in a sleep-on-side position. An arm cavity is defined by lower surfaces of the two cantilevered supports and a trunk rest cantilevered arm cavity surface that extends generally downward and inward.

12 Claims, 16 Drawing Sheets

(56) References Cited

U.S. PATENT DOCUMENTS

| | | | |
|---|---|---|---|
| 4,028,754 | A | 6/1977 | Eary, Sr. |
| 5,054,142 | A | 10/1991 | Owens |
| 5,214,814 | A | 6/1993 | Eremita et al. |
| 5,400,449 | A | 3/1995 | Satto |
| 5,509,153 | A | 4/1996 | Roschacher |
| 5,720,061 | A | 2/1998 | Giori et al. |
| 5,893,183 | A | 4/1999 | Bechtold, Jr. |
| 6,038,722 | A | 3/2000 | Giori et al. |
| 6,154,903 | A | 12/2000 | Wai-Chung |
| 6,185,768 | B1 | 2/2001 | Schlechter |
| 7,020,918 | B1 | 4/2006 | Tinsley |
| 7,536,741 | B1 | 5/2009 | Schultz |
| 7,698,766 | B2 | 4/2010 | Schultz |
| 8,220,091 | B2 * | 7/2012 | Schultz ..... 5/731 |
| 2006/0096034 | A1 | 5/2006 | Tucci |

OTHER PUBLICATIONS

Dale T. Read, A New Paradigm in Mattresses and Beds?, Specialty Sleep Association News, Sep. 18, 2007, http//www.sleepinformation.org/news.htm.

* cited by examiner

SLEEP SYSTEM

PRIORITY CLAIM

This application is a Continuation Application of U.S. patent application Ser. No. 12/765,718, filed Apr. 22, 2012, now U.S. Pat. No. 8,220,091 and which claims priority to U.S. Provisional Patent Application Ser. No. 61/214,389, filed Apr. 22, 2009 and is a Continuation-in-Part of U.S. patent application Ser. No. 12/755,172, filed on Apr. 6, 2010, now U.S. Pat. No. 8,234,735, which is a Continuation of U.S. patent application Ser. No. 12/740,741, filed on May 22, 2009, now U.S. Pat. No. 7,698,766, filed May 22, 2009, which is a Continuation of U.S. patent application Ser. No. 12/020,363, filed on Jan. 15, 2008, now U.S. Pat. No. 7,536,741, filed Jan. 25, 2008, all of which are incorporated by reference in their entireties.

BACKGROUND OF THE INVENTION

Various sleeping problems are commonly experienced by many people. For example, a person sleeping on a flat mattress may experience back aches and pains due to the non-alignment of their spine while sleeping. Furthermore, if the person's spine is not in alignment during sleep, discomfort, or injury may occur to the vertebrae disks, back muscles, and/or connecting ligaments.

As another example of a sleeping problem, if a person is sleeping on top of their arm, circulation to portions of the arm may be hindered. Such reduced circulation may result in a tingling, numbness, or even pain in the blood-deprived regions of the arm.

Nasal and sinus congestion may be exacerbated by sleeping on a flat mattress when the person is suffering from a cold or the flu. Further, acid reflux or the like are known to be more damaging at night when the afflicted person is sleeping.

FIG. 1 shows a lateral view 102 and a posterior view 104 of a spine 106. The names of the various portions of the spine 106 are illustrated. FIG. 2 shows anatomical reference planes of a person 202, namely the Sagittal plane 204, the coronal plane 206, and the axial plane 208.

The lateral view 104 of person 202 illustrates a natural, healthy curvature of the spine 106 with respect to the coronal plane 206. The posterior view 104 of person 202 illustrates a natural, healthy alignment of the spine 106 with respect to the Sagittal plane 204. When spine 106 is aligned along the Sagittal plane 204 in the illustrated straight-line orientation, the person 202 will be in a relatively comfortable position (absent other spinal injury, such as herniated vertebrae disks, arthritis, or the like). When the spine 106 is not in the straight-line alignment along the Sagittal plane 204, the person 202 may experience some level of discomfort. If the nonalignment of the spine 106 along the Sagittal plane 204 is maintained for a relatively long period of time, such as when the person 202 is sleeping at night or resting in bed during recovery from an illness or the like, the level of discomfort may increase to a very undesirable level. As noted above, injury to the vertebrae disks, back muscles, and/or connecting ligaments may result.

FIG. 3 shows a front view of a person 202 laying in a sleep-on-side position 302 on a prior art mattress 303. The person's head 304 is laying on the person's lower arm 306. Pillow 308 is supporting the person's lower arm 306 and head 304. The person's upper shoulder 310, upper arm 312, upper hip 314, lower hip 316, upper leg 318, lower leg 320, upper foot 322, and lower foot 324 are illustrated for the person 204 laying in the sleep-on-side position 302. The trunk 326 is that portion of the person 202 from the shoulder blades 406, 408 to the hips 314, 316.

FIG. 4 shows a rear view of the person 202 laying in the sleep-on-side position 302 on the prior art mattress 303. The person's spine 106 (illustrated conceptually as a series of line-connected squares) is not in alignment along the Sagittal plane 204 while laying in the sleep-on-side position 302. The spine 106 is oriented in a curve about an upper region 402 near the shoulders (cervical and thoracic portions of spine 106) and in a curve about the lower region 404 near the hips (lumbar and sacrum portions of spine 106). The person's upper shoulder blade 406 and lower shoulder blade 408 are also conceptually illustrated, and are aligned along the illustrated plane 410.

While laying in the sleep-on-side position 302, the spinal curvatures 402 and 404 may result in compression of the vertebrae disks (not illustrated, but well known as the soft tissue separating individual vertebrae of the spine 106). Such compression of the vertebrae disks is undesirable, and may even result to injury of the vertebrae disks. Further, if the vertebrae disks are already injured, the compression of the vertebrae disks caused by the spinal curvatures 402 and 404 may exacerbate the pain and further injure the vertebrae disks.

As is apparent from FIG. 4, the plane 410 of the shoulder blades 406, 408 is oriented at a non-perpendicular angle with respect the spine 106. This orientation of the shoulder blades 406, 408, alone or in combination with the spinal curvatures at regions 402 and/or 404, may result in discomfort and/or injury to the person's muscles and/or ligaments (not illustrated). For example, the person 202 may experience muscle spasms, cramping, and/or other types of back pain.

Accordingly, it is desirable to facilitate alignment of the spine 106 along the Sagittal plane 204 when the person 202 is laying in a sleep-on-side position 302. Further, it is desirable to facilitate alignment of the spine 106 along the Sagittal plane 204 when the person 202 is confined to bed rest during recovery from an illness or injury.

SUMMARY

An apparatus for facilitating sleep is disclosed. Embodiments of the sleep system receive a person's lower arm in an arm cavity of a person laying in a sleep-on-side position. An exemplary embodiment comprises a trunk rest and a head rest. The trunk rest comprises a trunk rest top surface configured to support a trunk of a person laying in a sleep-on-side position, a trunk rest bottom surface, a trunk rest cantilevered support at a head of the trunk rest that defines a trunk rest cantilevered arm cavity surface, and a top edge defined at a joining of the trunk rest top surface and the trunk rest cantilevered arm cavity surface. The trunk rest cantilevered arm cavity surface extends downward from the top edge and extends inward towards the trunk rest bottom surface. The head rest comprises a base portion, a first cantilevered support that extends outwardly from the base portion, and a second cantilevered support that extends outwardly from the base portion and is separated from the first cantilevered support. The first cantilevered support and the second cantilevered support are configured to rest on and be supported by the top edge of the trunk rest.

In various embodiments, unexpected and unforeseen benefits to a person sleeping in a sleep-on-side position are provided. Flat horizontal conventional sleep surfaces cause a disproportionate amount of pressure and weight on the joints of the person's arm, hand and shoulder, and do not allow the person's spine to be completely straight without compression. Sleeping with the various embodiments causes a reduction in stress on the person's shoulder, arm and hand when extended into the arm cavity. Also, the person's arm and hand are retained in a non-weight bearing position during sleep with a good range of motion. Accordingly, there is relieved stress and a reduced loss of blood circulation so that the resulting Paresthesia (hand and arm falling asleep) is reduced or eliminated. If the person leaves their limb in a position that otherwise constricts or impairs blood circulation, the limb's malnourished nerves will also eventually start to malfunction. The person may experience tingling, pain or numbness in the blood-deprived area as their sensory neurons fail. Continuous repeated stress and pressure on joints, tendons and ligaments can cause a variety of other functional ailments. Paresthesia can also be caused simply by blocking of the blood stream to a limb by applying weight and/or pressure on to the limb for extended periods of time. Removing the pressure by sleeping on the various embodiments will typically result in gradual relief of these paresthesias, often described as a "pins and needles" feeling.

Another unexpected and unforeseen benefit provided by various embodiments, especially those embodiments having an inclined trunk rest surface, to a person sleeping in a sleep-on-side position may be a reduction in acid reflux symptoms. Recent statistics indicate that about fifteen (15) million people in the US alone suffer from acid reflux disease. Acid reflux is more likely to occur when the afflicted person lies down. Reflux of acid is more damaging at night than during the day. During nighttime, when the person is lying down, it is easier for acid reflux to take place. The explanation for increased instances of acid reflux is simple. Gravity is not holding back the acid reflux, as it does when the person is in an upright position during the day. Additionally, the lessening of the effect of gravity permits the acid refluxed fluid to pass further up the esophagus and stay in the esophagus for a longer period of time, causing even more damage to the esophagus. Some health care professionals recommend elevating the head of the person's bed by six (6) inches to reduce or eliminate the symptoms of acid reflux. For example, inclined embodiments provide this benefit without the need to artificially raise the head of the person's bed.

Another unexpected and unforeseen benefit provided by various embodiments, especially those embodiments having an inclined trunk rest surface, to a person sleeping in a sleep-on-side position may be a reduction of blood pressure that is alleviated by an inclined embodiment. Elevating the person's upper body has been shown to reduce blood pressure.

Another unexpected and unforeseen benefit provided by various embodiments, especially those embodiments having an inclined trunk rest surface, to a person sleeping in a sleep-on-side position may be a reduction of nasal and sinus congestion. Research has shown that the human body has evolved to work better with gravity. A person's digestive, cardiac and respiratory systems, as well the sinus and lymph drainage systems, all work better when a person is vertical than when horizontal. Fluids more easily collect in sinus when in a horizontal position. Sleeping in a sleep-on-side position, and if at an incline, allows mucus and fluids to drain more easily decreasing sinus and nasal congestion resulting in reduced snoring and less mouth breathing, and the resulting dry mouth which can impair sleep.

Another unexpected and unforeseen benefit provided by various embodiments, especially those embodiments having an inclined trunk rest surface, to a person sleeping in a sleep-on-side position may be a reduction of snoring by sleeping comfortably on their side. Doctors recommend people sleep on their sides to reduce snoring. Back sleeping increases the tendency to snore. A common strategy is to tape a tennis ball on the back of the bed shirt forcing the person to sleep on their sides. Many people have trouble sleeping comfortably for long periods on their sides and roll over on to their back to get physical relief from the stress of compressing their shoulder, arm, hand, back and neck. Elevating the head while sleeping also allows for the full extension of the neck, opening air passageways, and thereby reducing the circumstances that cause snoring.

Yet another unexpected and unforeseen benefit provided by various embodiments, especially those embodiments having an inclined trunk rest surface, to a person sleeping in a sleep-on-side position may be an overall deeper sleep due to a comfortable position and a reduced need for changing sleep position. A low joint stress position provided to the person by the various embodiments will yield deeper sleep, as the body is not as often awakened to move out of a bad position or to turn over due to fatigue and loss of circulation on one set of body parts. The various embodiments disclosed herein have shown a reduction in sleep position changes during a normal sleep night. Research has shown that the number of nighttime awakenings determines overall quality of sleep and feelings of refreshment in the morning. When the regular pattern of sleep is disturbed, a sleep deficiency is created which can be compounded over time. The longer the body can maintain an ideal pressure reducing contact plane with the sleep surface, the longer it will take to send a "roll over" signal to the brain. The signal to shift position comes from a build-up of tension or pressure in the body's skeletomuscular system. Such signals to the brain interrupts deep sleep or REM sleep cycles, which decreases the body's ability to repair and rejuvenate itself.

BRIEF DESCRIPTION OF SELECTED DRAWINGS

The preferred and alternative embodiments of the present invention are described in detail below with reference to the following drawings.

Figure 17A:
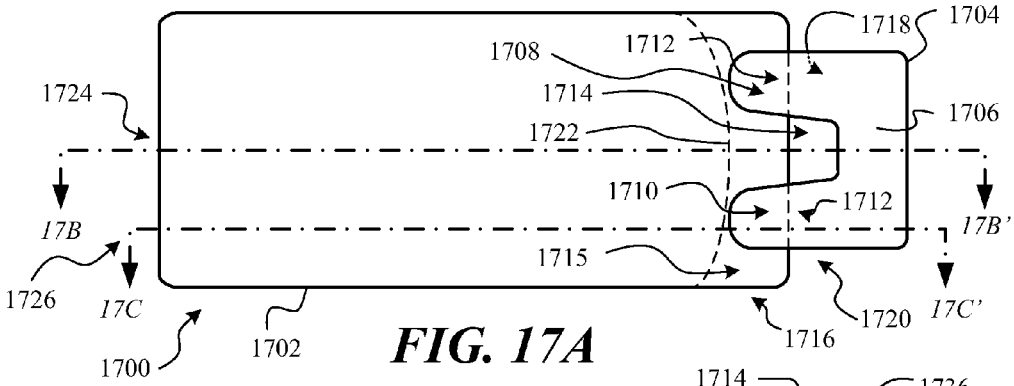
Figure 17B:
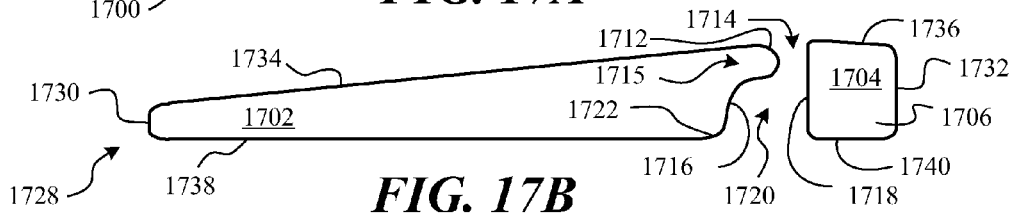
Figure 17C:
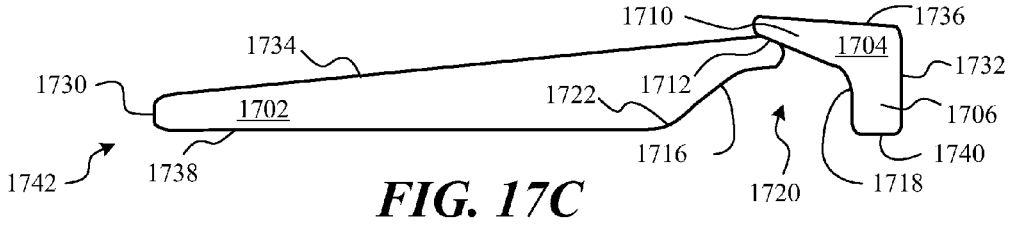
Figure 18A:
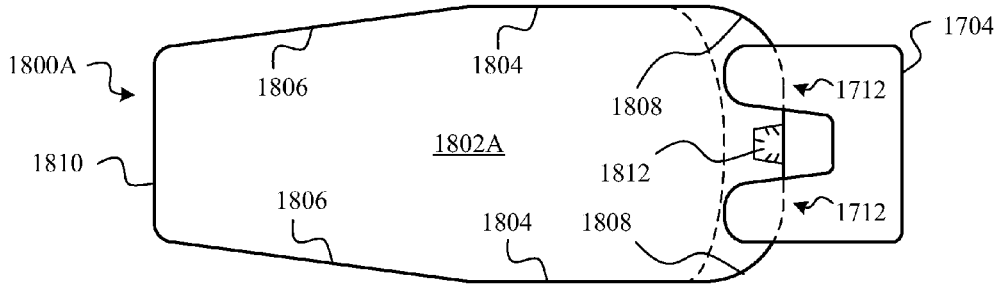
Figure 18B:
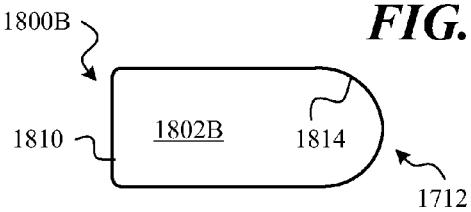
Figure 18C:
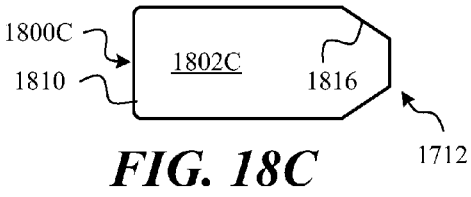
Figure 19:
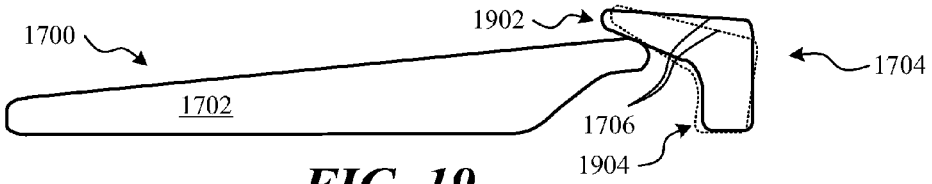
Figure 20:
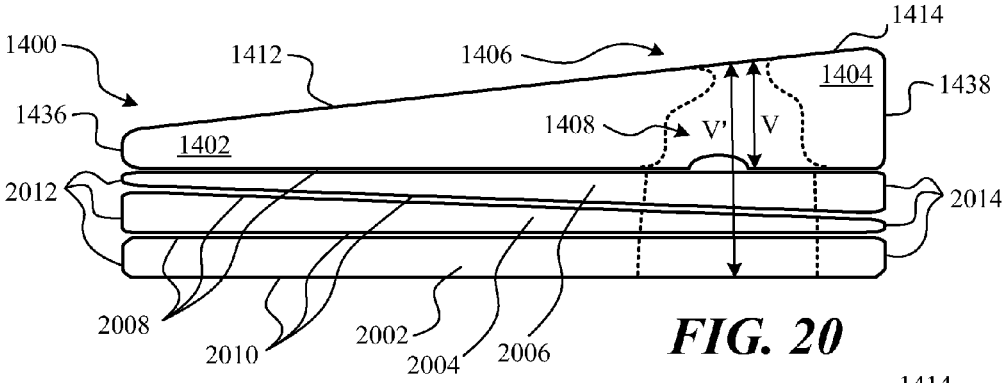
Figure 22A:
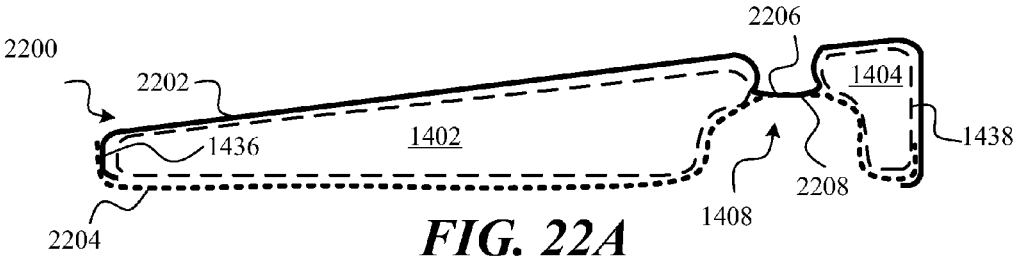
Figure 22B:
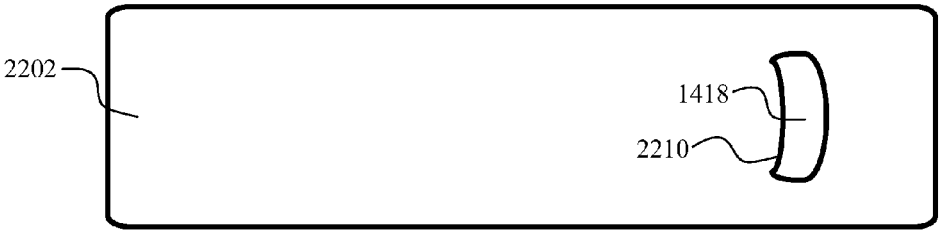

FIGS. 17A, 17B, and 17C illustrate various views of an exemplary two portion contoured sleep system;

FIGS. 18A, 18B, and 18C illustrate various views of alternative embodiments of the two portion contoured sleep systems;

FIG. 19 is a side view of the two portion contoured sleep system embodiment illustrating position adjustment of the head rest;

FIG. 20 shows an embodiment of the contoured sleep system with a plurality of trunk and head rest riser bodies that extend the arm cavity vertical extent;

FIG. 22 shows an embodiment of the contoured sleep system with a plurality arm cavity riser bodies that reduce the arm cavity vertical extent; and FIGS. 22A-22B show an exemplary sheet, mattress pad, or other enclosure configured for use with embodiments of the unibody contoured sleep system.

DESCRIPTION

Figure 3:
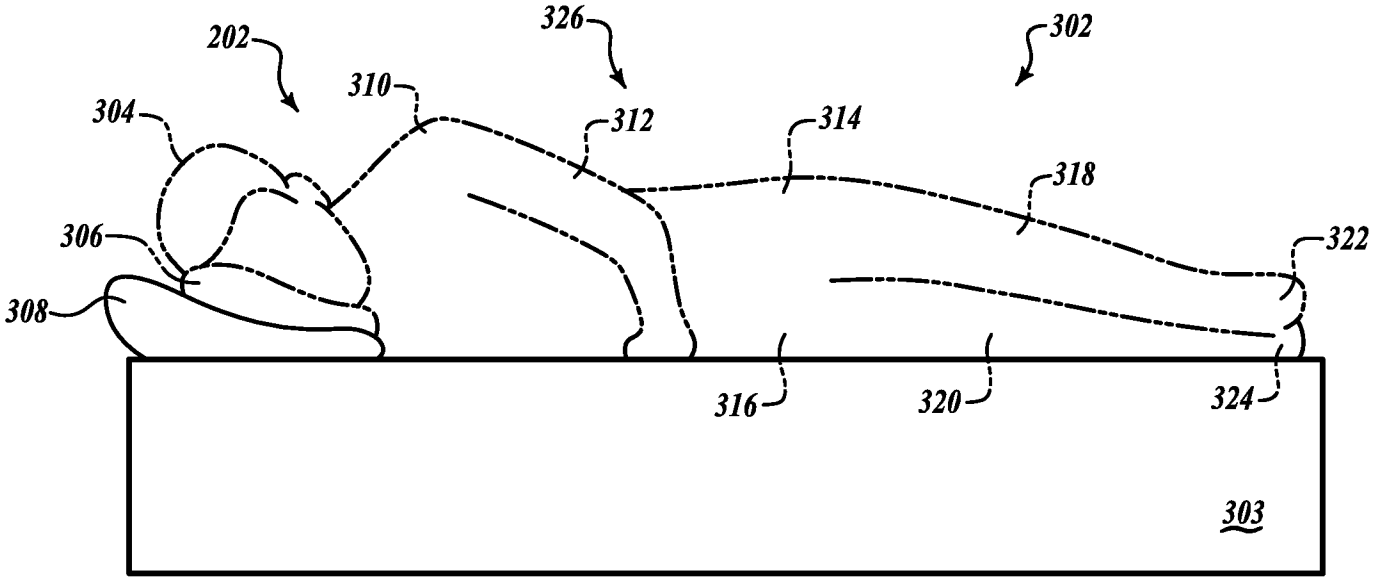
FIG.3 (PRIOR ART)
FIG. 3 shows a front view of a person laying in a sleep-on-side position on a prior art mattress.
Figure 4:
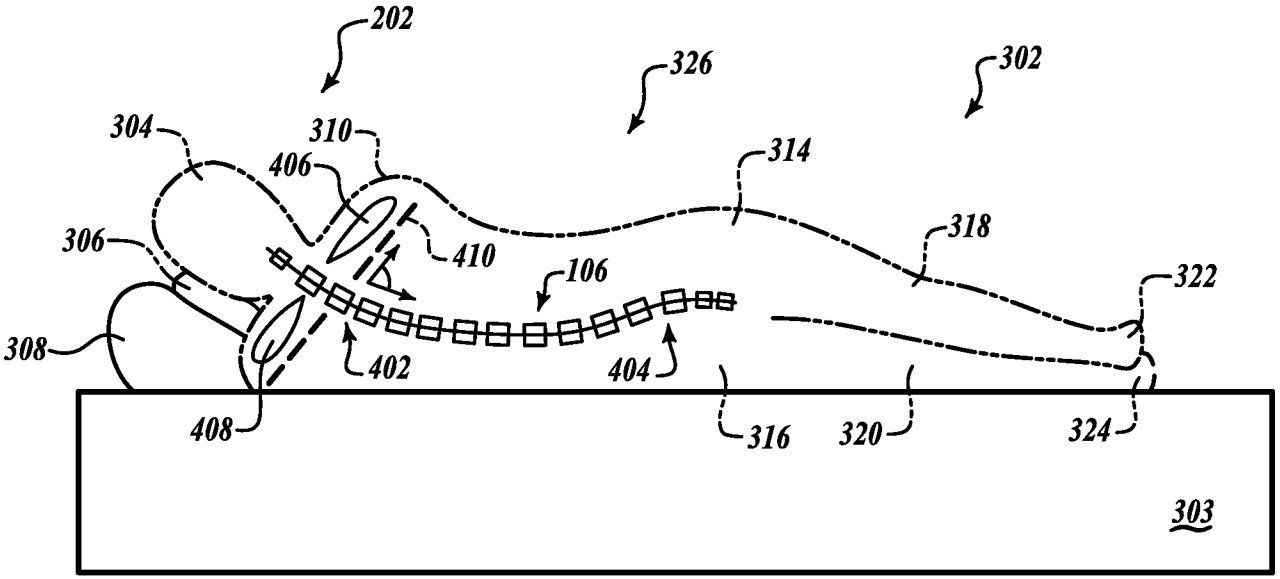
FIG. 4 (PRIOR ART)
FIG. 4 shows a rear view of the person laying in the sleep-on-side position on a prior art mattress.

Embodiments of the contoured sleep system facilitate alignment of a person's spine 106 at least along the Sagittal plane 204 when sleeping in the sleep-on-side position 302 (FIGS. 3 and 4, for example). Spinal alignment along the Sagittal plane 204 is facilitated by a cavity that receives the lower arm a person laying in the sleep-on-side position 302. That is, portions of the spine 106 are positioned within the Sagittal plane 204. Other embodiments may include a hip concavity to receive a hip and/or leg concavity to received a leg of the person laying in the sleep-on-side position. Non-limiting examples of various embodiments are described in greater detail hereinbelow.

Figure 5:
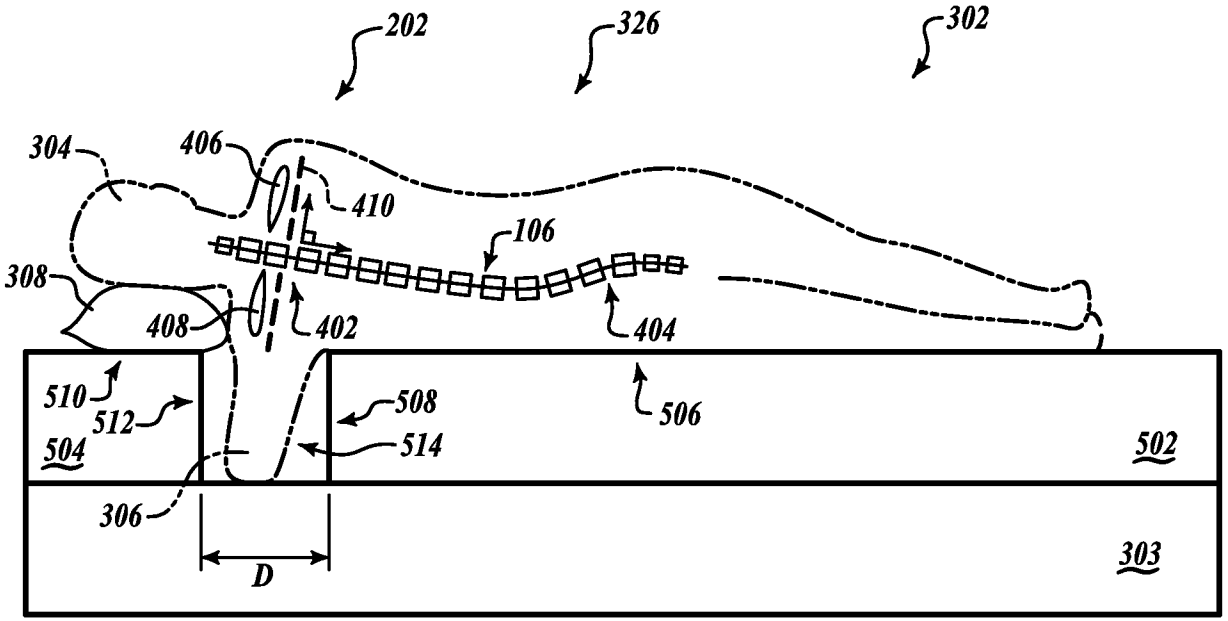
FIG. 5 shows an embodiment of the contoured sleep system with a person laying in a sleep-on-side position thereon.

FIG. 5 shows an embodiment of the contoured sleep system with a person 202 laying in a sleep-on-side position 302 thereon. This exemplary embodiment of a contoured sleep system includes a trunk rest 502 and a head rest 504. The trunk rest 502 and head rest 504 are on top of a conventional mattress 303 or on top of anther suitable surface, such as a floor, base, or the like.

The trunk rest 504 is defined, in part, by a trunk rest surface 506 and a trunk rest face 508. The trunk rest surface 506 supports the trunk 326 of a person 202 laying in a sleep-on-side position 302.

The head rest 504 is defined, in part, by a head rest surface 510 and a head rest face 512. The head rest surface 510 supports the person's head 304 directly or indirectly via pillow 308.

When the trunk rest 502 and the head rest 504 are spaced apart, a cavity 514 is formed. Accordingly, the head rest face 512 opposes the trunk rest face 508 and is separated from the trunk rest face 508 by a separation distance D such that the trunk rest 502 and the head rest 504 cooperate to define the cavity 514. Cavity 514 receives the lower arm 306 of the person 202 laying in the sleep-on-side position 302. The separation distance D may be fixed or may be adjustable.

Figure 2:
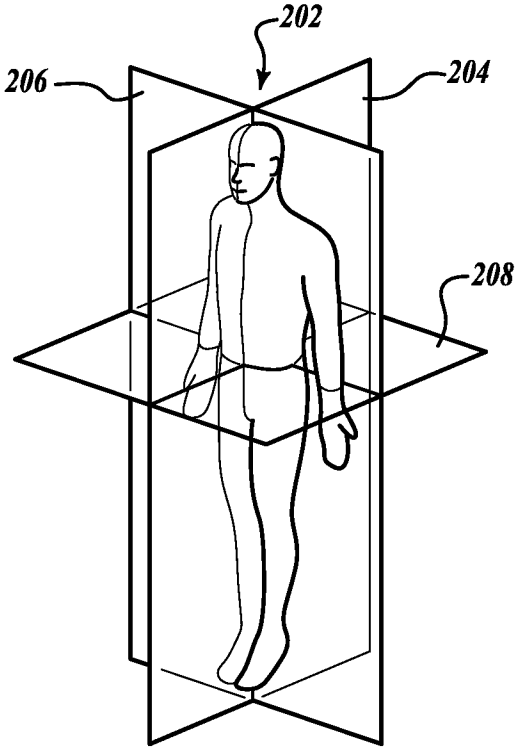
FIG. 2 (PRIOR ART)
FIG. 2 shows anatomical reference planes of a person.
Figure 1:
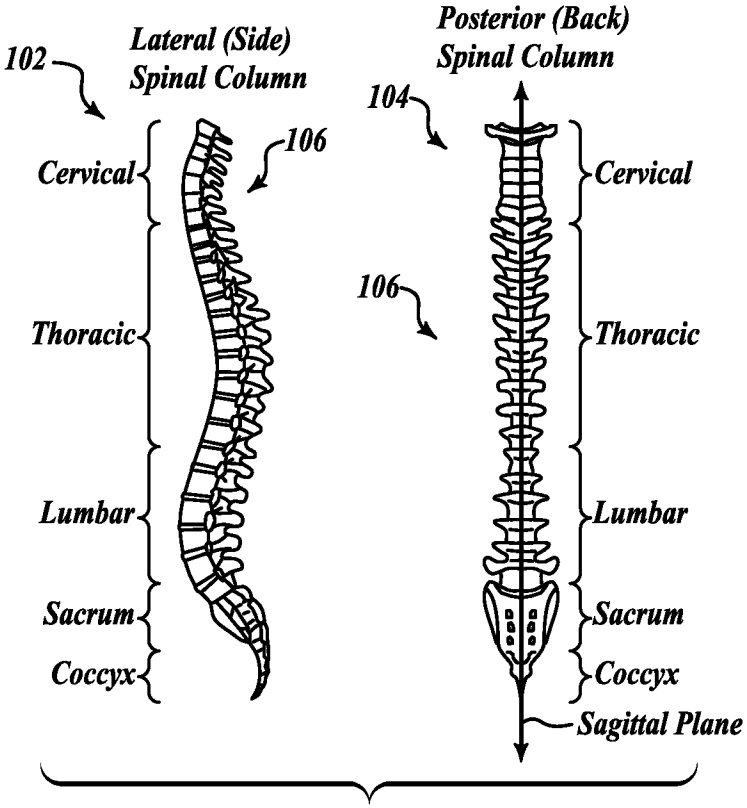
FIG. 1 (PRIOR ART)
FIG. 1 shows front and lateral views of a spine.

When the person's lower arm 306 is in the cavity 514, the spine region 402 is substantially aligned along the Sagittal plane 204 (FIG. 2). As illustrated in FIG. 5, the vertebrae of the spine 106 (conceptually corresponding to the illustrated line-connected boxes) about region 402 are substantially aligned. Since the vertebrae in the region 402 are aligned, compression of the vertebrae disks (not illustrated) between each vertebrae may be substantially reduced, or even eliminated, thereby resulting in less discomfort to the person 202 and/or may result in less injury to the vertebrae disks.

Further, the plane 410 of the shoulder blades 406, 408 is oriented at substantially a perpendicular angle with respect the spine 106 about region 402. Accordingly, one skilled in the art appreciates that the illustrated orientation of the shoulder blades 406, 408 results in less discomfort and/or injury to the person's muscles and/or connecting ligaments (not illustrated). Also, the shoulder of the person laying in the sleep-on-side position is supported with the upper corner of the trunk rest 502.

Embodiments of the contoured sleep system employ comfortable, flexible materials in the construction of the trunk rest 502 and/or the head rest 504. Either may be constructed similar to a conventional mattress, adjustable position mattress, air bed, water bed, or poly material. The trunk rest 502 and the head rest 504 may be similarly constructed, or may be constructed of different materials.

Embodiments of the contoured sleep system that are configured to lay on top of a conventional mattress, the length and/or width of the trunk rest 502 and/or the head rest 504 may correspond to the underlying mattress. For example, the length and/or width of the trunk rest 502 and/or the head rest 504 may correspond twin, double, single, Queen, King, or other mattress dimensions. In other embodiments, the width of the trunk rest 502 and/or the head rest 504 may be approximately half of the width of a standard dimension mattress. For example, two people often share a Queen or King mattress. If only one person is using an embodiment of the contoured sleep system, a half-width embodiment accommodates one person while the other person sleeps on their portion of the mattress.

Figure 6:
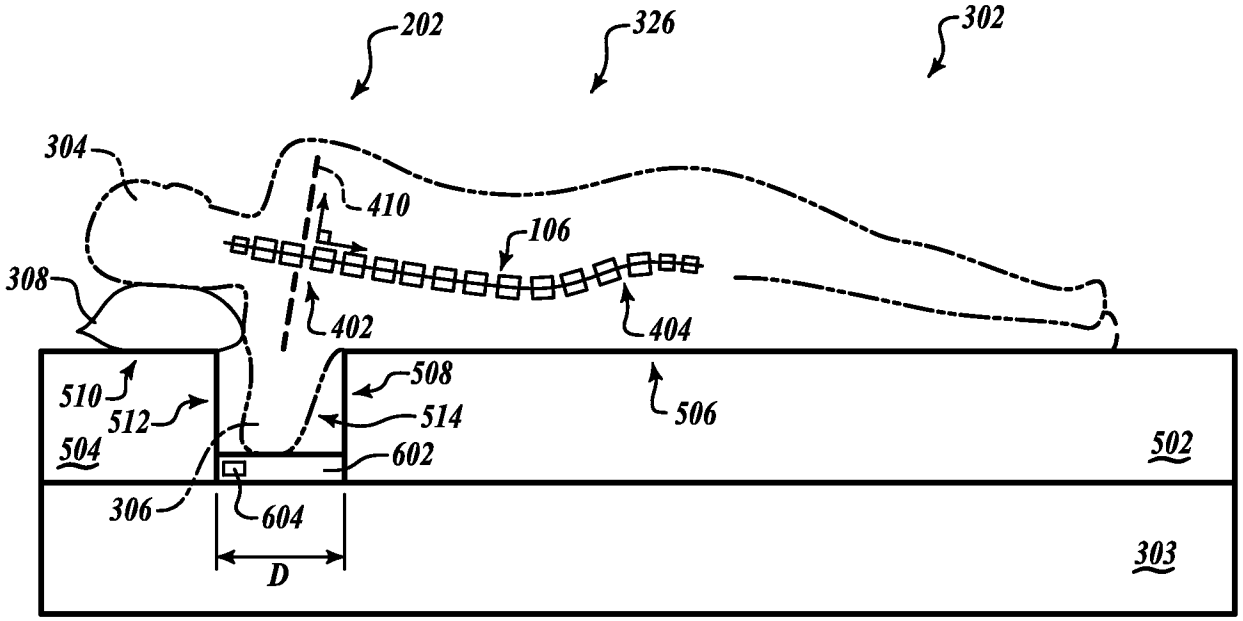
FIGS. 6-11 show alternative embodiments of the contoured sleep system with the person laying in the sleep-on-side position thereon.

FIG. 6 shows an alternative embodiment of the contoured sleep system with a person 202 laying in a sleep-on-side position 302 thereon. This embodiment includes a spacing member 602 between the trunk rest 502 and the head rest 504. The spacing member 602 is operable to maintain the separation distance D at a desired value.

In one embodiment, the spacing member 602 is adjustable. Any suitable adjustable means may be used. For example, the spacing member 602 may include a plurality of portions 604 that may be added or removed to define a value of the separation distance D. Other embodiments may employ an adjustable member 604 that is adjustable to define the separation distance D.

For convenience, the spacing member 602 is illustrated as being between the trunk rest 502 and a head rest 504. In some embodiments, the sides of the spacing member 602 may be optionally physically coupled to the trunk rest face 508 and/or the head rest face 512. For example, buttons, Velcro, zippers or other suitable fasteners may be used to physically couple the spacing member 602 to the trunk rest face 508 and/or head rest face 512.

In some embodiments, the spacing member 602 is configured to have its end portions (not illustrated) fit underneath the trunk rest 502 and a head rest 504 such that the weight of the trunk rest 502 and/or head rest 504, in addition to the person 202, secures the position of the spacing member 602. For example, a fabric sheet, ribbon, relatively thin rigid member, or the like may be attached to either or both ends of the spacing member 602. When placed under the trunk rest 502 and/or head rest 504, the weight of the trunk rest 502 and/or head rest 504, in addition to the person 202, secures the position of the spacing member 602.

Figure 7:
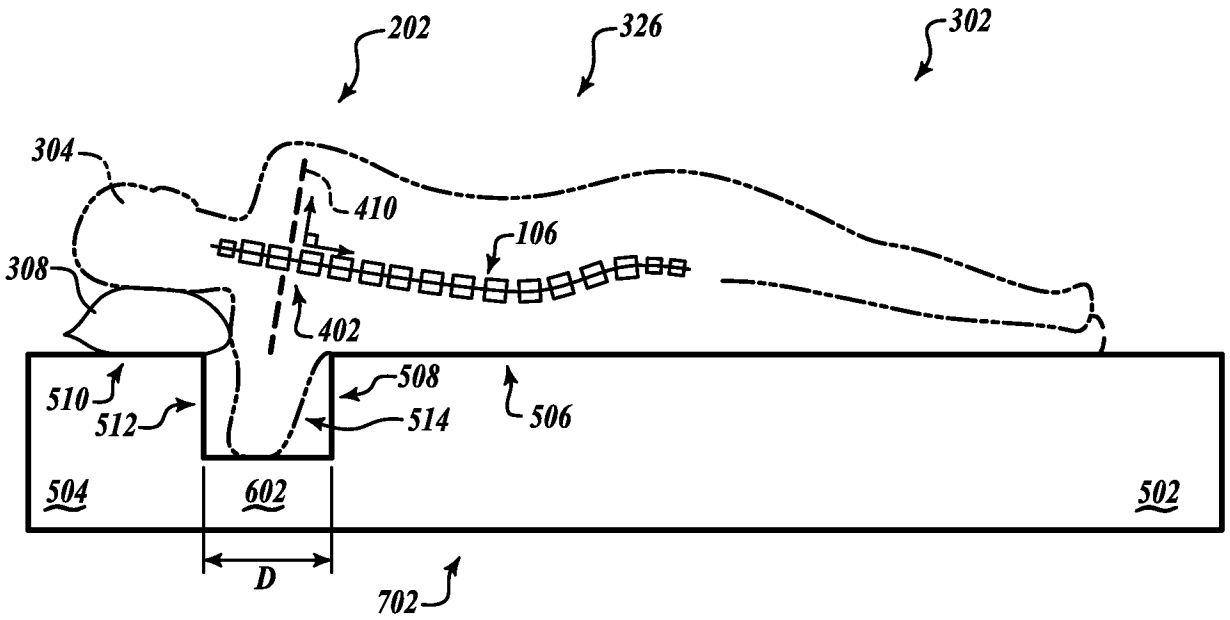

FIG. 7 shows an alternative embodiment of the contoured sleep system with the person 202 laying in the sleep-on-side position 302 thereon. In this exemplary embodiment, the trunk rest 502, the head rest 504, and the spacing member 602 are formed together in a unibody structure 702. The unibody structure 702 may be designed to fully and separately support the person 202 much like a conventional mattress that fits on a frame or that fits on top of a box spring structure or the like.

Alternatively, or additionally, the unibody structure 702 may be configured to lay on top of a conventional mattress or other support structure.

Figure 8:
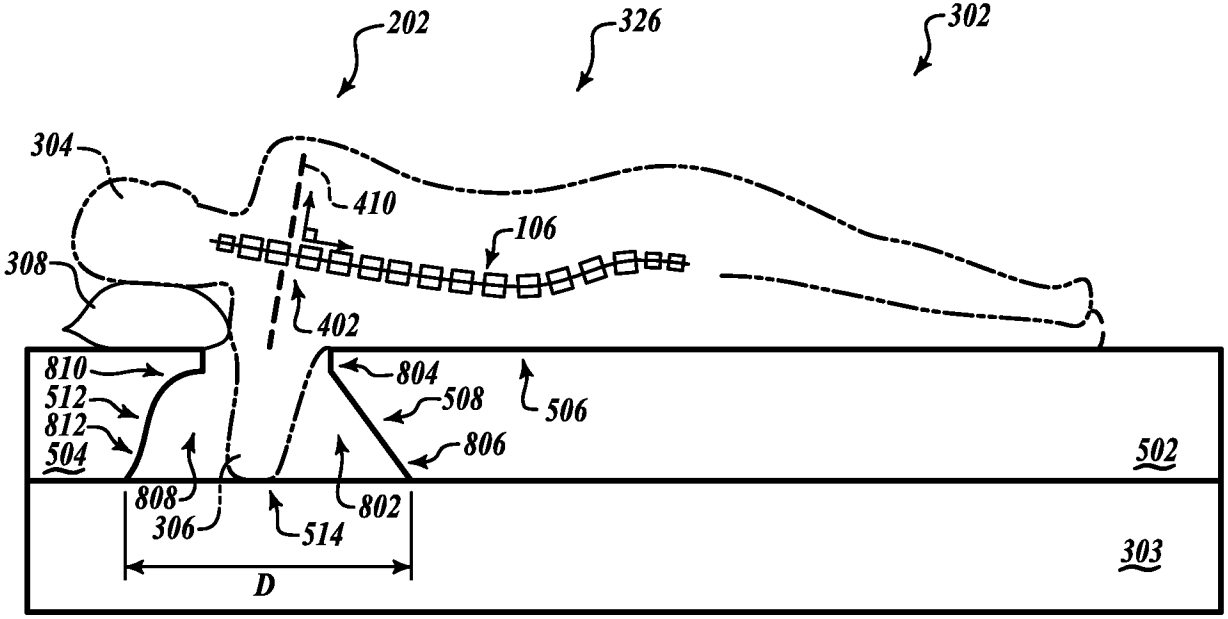

FIG. 8 shows an alternative embodiment of the contoured sleep system with the person 202 laying in the sleep-on-side position 302 thereon. The trunk rest face 508 is inwardly inclined such that the cavity 514 includes a region 802 that may facilitate a more comfortable accommodation of the lower arm 306. That is, the separation distance D increases from an upper portion 804 of the trunk rest face 508 to a lower portion 806 of the trunk rest face 508.

Additionally, or alternatively, the head rest face 512 is inwardly inclined such that the cavity 514 includes a region 808 that may facilitate a more comfortable accommodation of the lower arm 306. That is, the separation distance D increases from an upper portion 810 of the head rest face 512 to a lower portion 812 of the head rest face 512.

Figure 9:
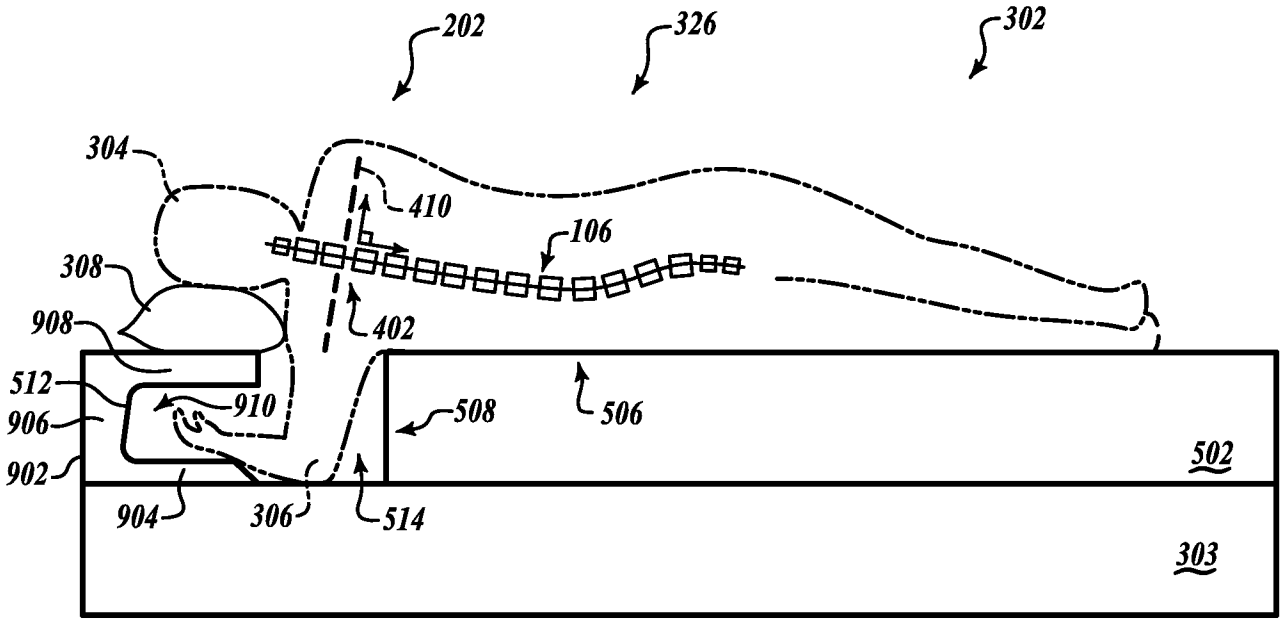

FIG. 9 shows an alternative embodiment of the contoured sleep system with the person 202 laying in the sleep-on-side 302 position thereon. The head rest 902 includes a head rest base 904, a head rest precipice support 906 coupled to the head rest base 904, and a head rest precipice 908 coupled to the head rest precipice support 906 and oriented above the head rest base 904. In this embodiment, the head rest face 512 is an exterior side of the head rest precipice support 906.

The head rest base 904, the head rest precipice support 906, and the head rest precipice 908 cooperate to form a head rest face concavity 910 such that the cavity 514 is enlarged. The enlarged cavity 514 more comfortably accommodates the person's lower arm 306.

Figure 10:
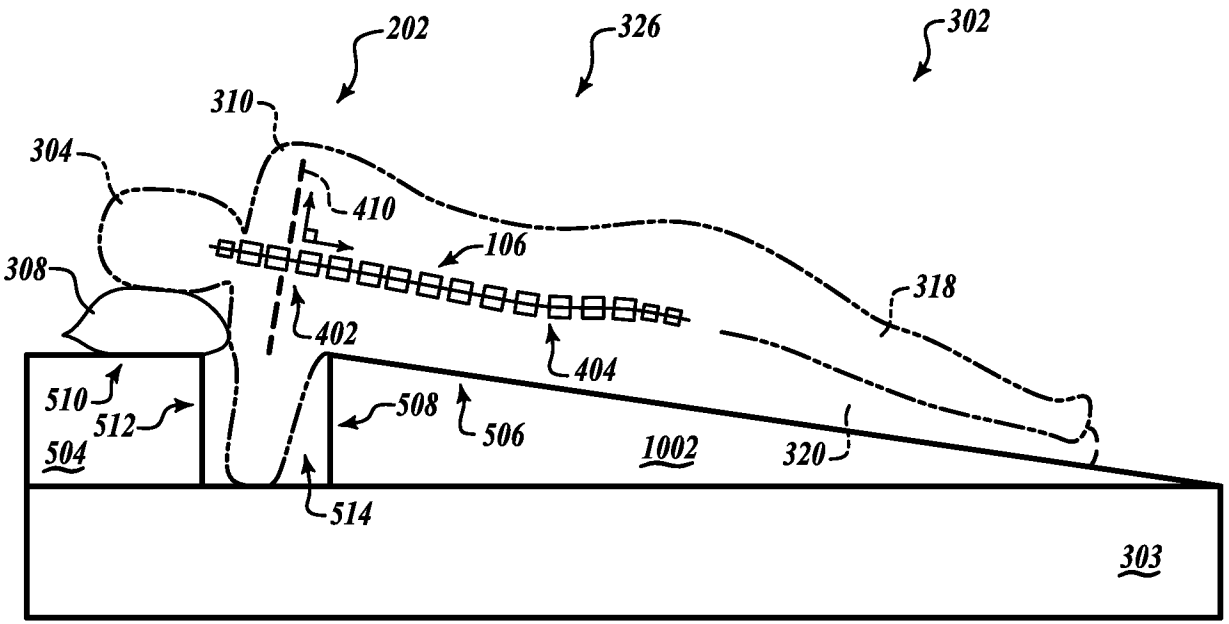

FIG. 10 shows an alternative embodiment of the contoured sleep system with the person 202 laying in the sleep-on-side position 302 thereon. In this exemplary embodiment, the trunk rest 1002 is substantially wedge shaped. The wedge shaped trunk rest 1002 results from an inclination of the trunk rest surface 506 in a downward direction from the trunk rest face 508. Accordingly, the wedge shaped trunk rest 1002 is operable to orient the person 202 laying in the sleep-on-side position 302 at an incline.

The inclined orientation of the person 202 may further align the spine 106 along region 402. Also, the inclined orientation of the person 202 may facilitate alignment of the spine 106 along the region 404. The inclined position may provide other benefits to the person 202, such as improved circulation, since the person's legs 318, 320 are lower than the person's shoulder 310. If the person 202 laying in the sleep-on-side position 302 is recovering from a cold or the flu, the inclined orientation may facilitate drainage of the person's sinus and/or lungs since the person's legs 318, 320 are lower than the person's shoulder 310.

Figure 11:
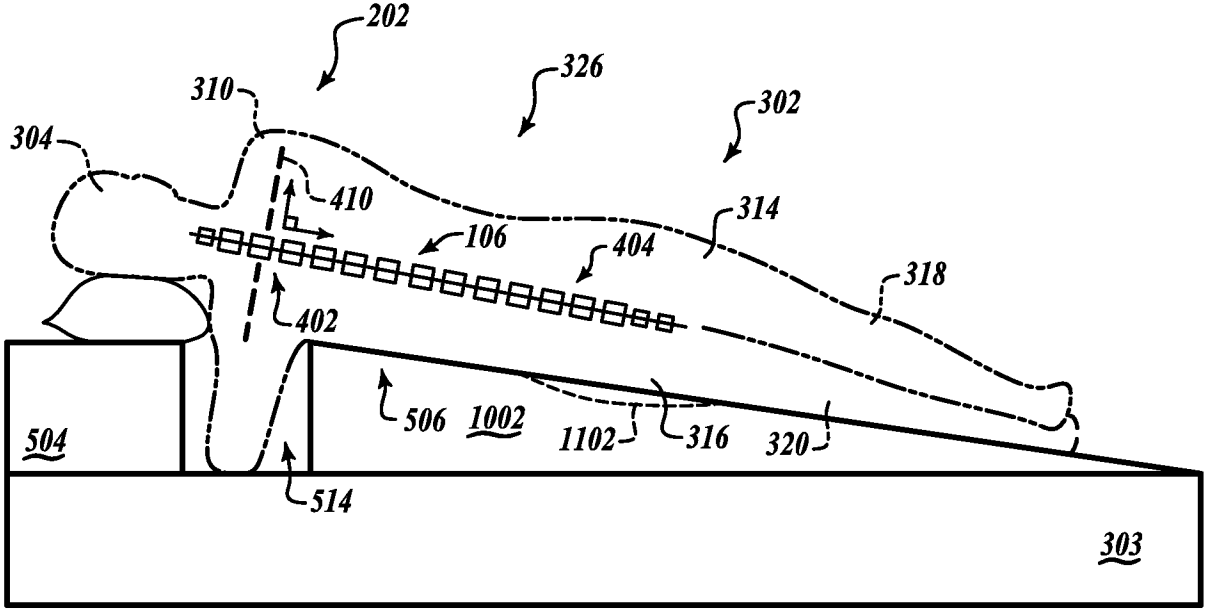

FIG. 11 shows an alternative embodiment of the contoured sleep system with the person 202 laying in the sleep-on-side position 302 thereon. In this exemplary embodiment, the trunk rest surface 506 of a substantially wedge shaped trunk rest 1002 includes a hip concavity 1102. The hip concavity 1102 is operable to further orient the person 202 laying in the sleep-on-side position 302 by lowering the person's hips 314, 316 relative to the person's head 304. Thus, the region 404 of the person's spine 106 is further aligned along the Sagittal plane 204 (FIG. 2). The hip concavity 1102 may be used in non-inclined embodiments of the contoured sleep position.

When the hip concavity 1102 is employed on the substantially wedge shaped trunk rest 1002 such that the person 202 laying in the sleep-on-side position 302 is oriented at an incline, the hip concavity 1102 aids in maintaining position of the person 202. That is, the person 202 does not slide down the incline.

Figure 12:
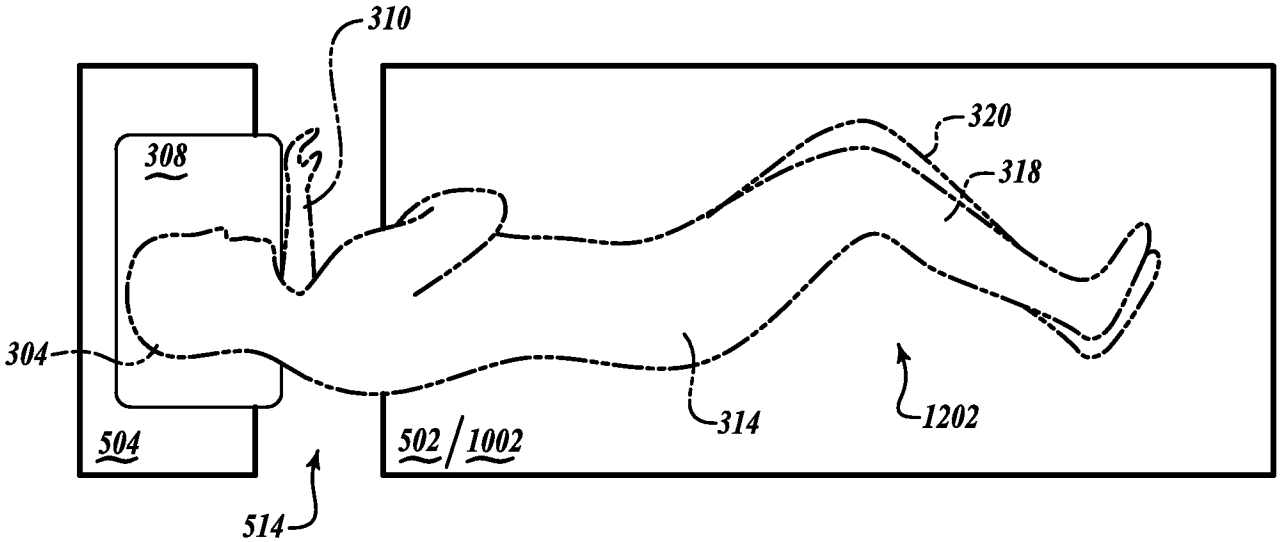
FIG. 12 shows a top view of a embodiment of the contoured sleep system with the person laying in the sleep-on-side position thereon.

FIG. 12 shows a top view of a embodiment of the contoured sleep system with the person 202 laying in the sleep-on-side position 302 thereon. Often, at least one of the person's legs 318, 320 may be oriented at an angle. That is, the person 202 laying in the sleep-on-side position 302 has one or both of their legs in a bent position 1202.

Figure 13:
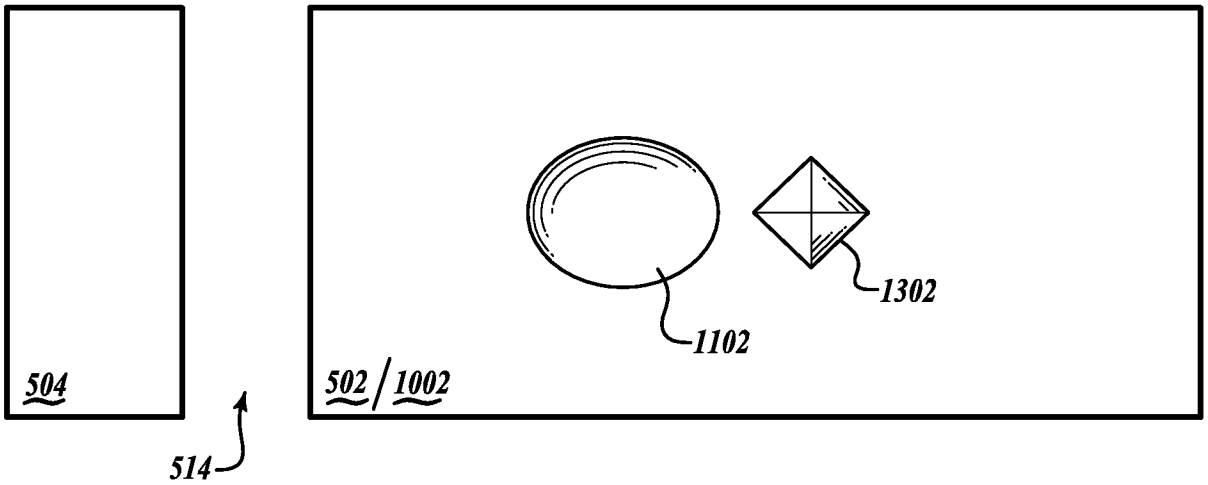
FIG. 13 shows a top view of an alternative embodiment of the contoured sleep system having a hip depression and a leg channel thereon.

FIG. 13 shows a top view of an alternative embodiment of the contoured sleep system having an optional hip depression 1102 and an optional leg channel 1302 thereon. Leg channel 1302 may be a depression or a protrusion. The leg channel 1302 maintains the person's legs 318, 320 in the bent position 1202 (FIG. 12). The leg channel 1302 may be formed by a trench in the trunk rest surface 506 of the wedge shaped trunk rest 1002. In other embodiments, the leg channel 1302 may be formed by an outward protrusion on the trunk rest surface 506 of the wedge shaped trunk rest 1002.

Maintaining the person's legs 318, 320 in the bent position 1202 may further facilitate spinal alignment. When the leg channel 1302 is employed on the substantially wedge shaped trunk rest 1002 such that the person 202 laying in the sleep-on-side position 302 is oriented at an incline, the leg channel 1302 aids in maintaining position of the person 202.

In the various embodiments described above, the spacing member 602 (FIGS. 6 and 7) may be optionally included as a separate member. Or, the trunk rest 502 or the trunk rest 1002, the head rest 504, and the spacing member 602 may form a unibody structure 702 (FIG. 7) as described above. The spacing member 602 may be used with any embodiment.

In some embodiments, the height of the head rest face 512 is greater than a height of the trunk rest face 508. That is, the height of the head rest 504 is greater than the height of the trunk rest 502. Accordingly, the person's spine 106 may be further aligned along the Sagittal plane 204 by lowering the person's shoulders and/or hips relative to the person's head 304 when the person 202 is laying in the sleep-on-side position 302.

FIGS. 14A, 14B, 14C, 14D and 14E illustrate various views of an exemplary embodiment wherein the trunk rest and the head rest portions are fabricated as portions of a unibody contoured sleep system 1400. The exemplary unibody contoured sleep system 1400 comprises a trunk rest 1402 portion, a head rest 1404 portion, and a connecting portion 1406. The connecting portion 1406 is configured to retain the trunk rest 1402 and the head rest 1404 in position with respect to each other. The trunk rest 1402, the head rest 1404, and the connecting portion 1406 cooperate to define an arm cavity 1408 that receives the person's arm when laying in the sleep-on-side position.

The trunk rest 1402, the head rest 1404, and the connecting portion 1406 are joined in any suitable fashion so as to form a substantially unibody structure. In an example embodiment, the trunk rest 1402, the head rest 1404, and/or the connecting portion 1406 are formed using a molded poly-foam type material. Any suitable material may be used. Non-limiting examples include latex, cottons, or a spring construction. In other embodiments, the trunk rest 1402, the head rest 1404, and/or the connecting portion 1406 may be separately formed, and then fastened, glued or otherwise secured together.

Figure 14A:
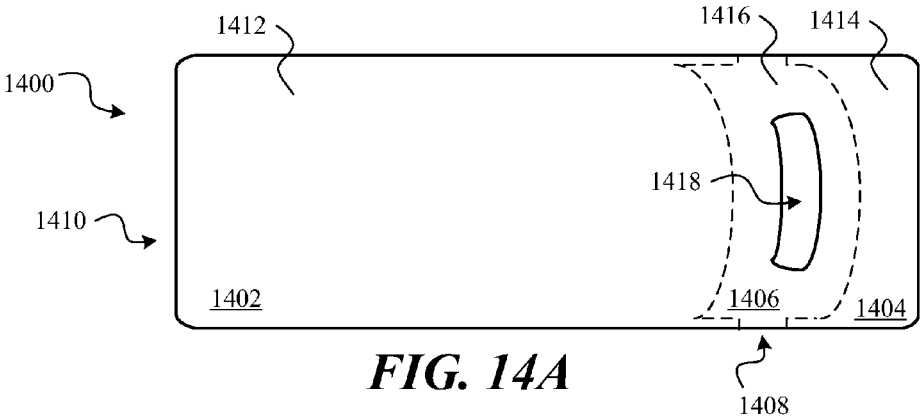
FIGS. 14A-14E illustrate various views of an exemplary embodiment wherein the trunk rest and the head rest portions are fabricated as portions of a unibody contoured sleep system.

FIG. 14A shows view of a top surface 1410 of the exemplary embodiment of the unibody contoured sleep system 1400. The top surface 1410 of the unibody contoured sleep system 1400 includes a trunk rest surface 1412, a head rest surface 1414, and a connecting portion top surface 1416. An arm aperture 1418 is included in the connecting portion top surface 1416. The arm aperture 1418 provides an opening for entry of the person's arm into the arm cavity 1408. The connecting portion top surface 1416 provides support to the person's lower shoulder and armpit area when laying in the sleep-on-side position.

Figure 14B:
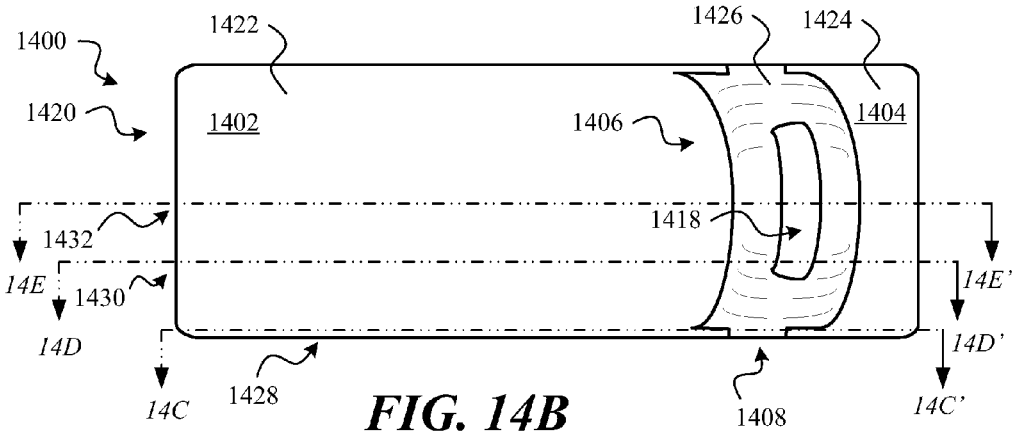

FIG. 14B shows a view of a bottom surface 1420 of the exemplary unibody contoured sleep system 1400. The bottom surface 1420 includes a trunk rest base 1422, a head rest base 1424, and an arm cavity surface 1426. The arm cavity surface 1426 extends up to the arm aperture 1418 and receives the person's arm into the arm cavity 1408. The arm cavity surface 1426 defines the arm cavity extent associated with the arm cavity 1408.

Figure 14C:
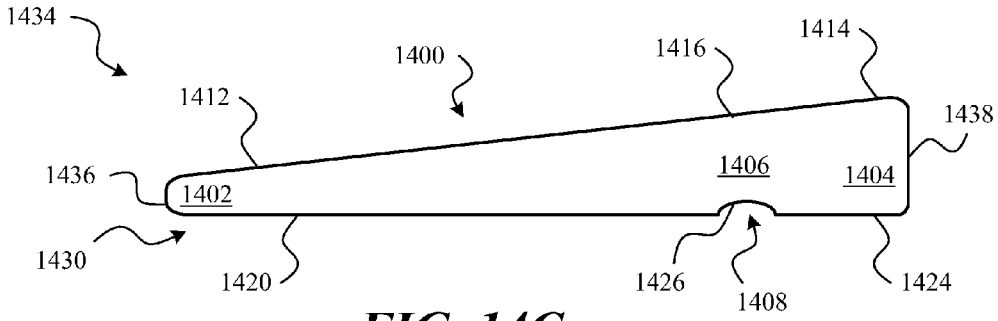
Figure 14D:
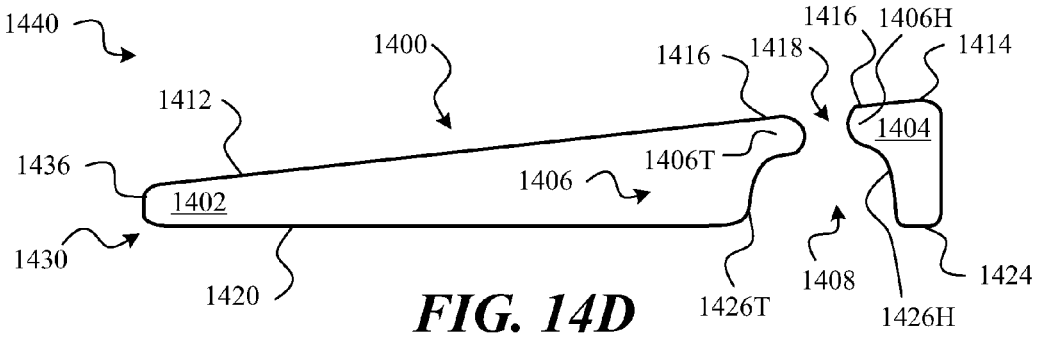
Figure 14E:
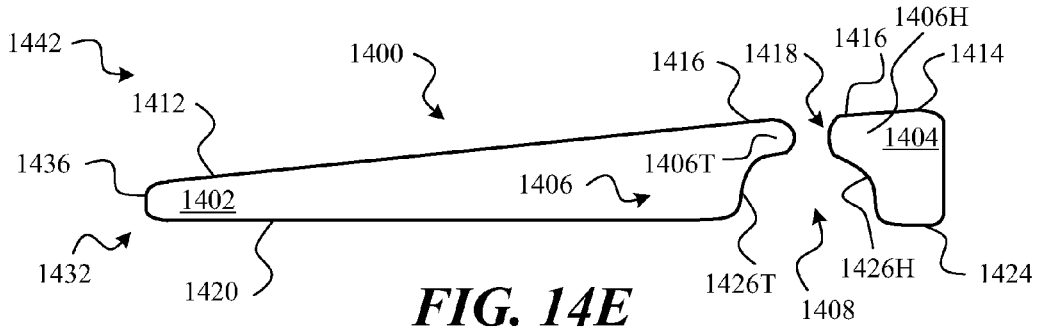

FIG. 14B indicates three cross sectional views 14C-14C', 14D-14D', and 14E-14E' (corresponding to FIGS. 14C, 14D and 14E, respectively). The cross sectional view 14C-14C' corresponds to an edge section 1428 generally located near the outer periphery of the exemplary unibody contoured sleep system 1400. The cross sectional view 14D-14D' corresponds to a first interior section 1430 generally located between the centerline of the exemplary unibody contoured sleep system 1400 and the edge section 1428. The cross sectional view 14E-14E' corresponds to a central section 1432 generally located near the central line of the exemplary unibody contoured sleep system 1400.

FIG. 14C shows the cross sectional view 1434 (corresponding to the edge section 1428 indicated by the illustrated section line 14C-14C' in FIG. 14B, the "C" cross section) of the exemplary unibody contoured sleep system 1400. The edge section 1428 comprises portions of the trunk rest 1402, the head rest 1404, and the connecting portion 1406. An end surface 1436 of the trunk rest 1402 defines an end of the exemplary unibody contoured sleep system 1400. An opposing end surface 1438 of the head rest 1404 defines an opposing end of the exemplary unibody contoured sleep system 1400.

The connecting portion 1406, as noted above, retains the trunk rest 1402 and the head rest 1404 in position with respect to each other. Generally, the arm cavity surface 1426 and the defined portion of the arm aperture 1418 along the edge section 1428 are relatively small. Thus, support is provided to the connecting portion top surface 1416. Also, the relatively small size of the illustrated arm cavity 1408 of the edge section 1428 facilitates air flow for the comfort of the person's arm when in the arm cavity 1408. In some embodiments, the arm cavity surface 1426 and the defined arm cavity 1408 are absent such that the trunk rest base 1422 and the head rest base 1424 are connected and substantially aligned with each other.

In this exemplary embodiment, a height of the end surface 1436 of the trunk rest 1402 is substantially less than the height of the opposing end surface 1438 of the head rest 1404. Accordingly, the trunk rest surface 1412, the head rest surface 1414, and the connecting portion top surface 1416 of the exemplary unibody contoured sleep system 1400 are generally oriented along a gentle incline. In the various embodiments, the relative heights of the end surfaces 1436 and 1438 may vary so as to provide differing levels of incline. In one embodiment, the relative heights of the end surface 1436 and 1438 are the same such that there is no incline.

The distance between the end surfaces 1436 and 1438 defines the length of the exemplary unibody contoured sleep system 1400. In some embodiments, the length of the unibody contoured sleep system 1400 corresponds to a prior art mattress or other surface. Thus, the bottom surface 1420 unibody contoured sleep system 1400 can rest on top of the prior art mattress or other surface such as a topper, platform, or the like.

FIG. 14D shows a cross sectional view 1440 (corresponding to the interior section 1430 indicated by the illustrated section line 14D-14D' in FIG. 14B, the "D" cross section) of the exemplary unibody contoured sleep system 1400. The interior section 1430 comprises different portions of the trunk rest 1402, the head rest 1404, and the connecting portion 1406.

The connecting portion 1406 is now separated into two cantilevered portions (a cantilevered support 1406T portion connected to the trunk rest 1402 and a cantilevered support 1406H portion connected to the head rest 1404) by the arm aperture 1418 and by a portion of the arm cavity 1408. The first cantilevered support 1406T and the second cantilevered support 1406H are facing cantilevered portions that cooperated to define the arm cavity 1408. The arm cavity 1408 is relatively large, having sufficient room to accommodate the person's arm.

The cantilevered support 1406T portion, and its associated arm cavity surface 1426T, is generally a cantilevered protrusion extending outward from the trunk rest 1402. The associated arm cavity surface 1426T defines a portion of the arm cavity 1408. Thus, the person's shoulder and armpit area may rest upon an edge of the cantilevered support such that the person's arm may comfortably reside in the arm cavity 1408 under the cantilevered support 1406T while laying in the sleep-on-side position.

Optionally, the second cantilevered support 1406H portion, and its associated arm cavity surface 1426H, is generally a second cantilevered protrusion extending outward from the head rest 1404. The associated arm cavity surface 1426H defines a second optional portion of the arm cavity 1408. Thus, the person's arm may more comfortably reside in the arm cavity 1408 under the cantilevered support 1406H while sleeping.

FIG. 14E shows the cross sectional view 1442 (corresponding to the central section 1432 indicated by the illustrated section line 14E-14E' in FIG. 14B, the "E" cross section) of the exemplary unibody contoured sleep system 1400. The interior central section 1432 comprises different portions of the trunk rest 1402, the head rest 1404, and the connecting portion 1406.

The connecting portion 1406 is also separated into two portions (the cantilevered support 1406T portion and the cantilevered support 1406H) by the arm aperture 1418 and by another portion of the arm cavity 1408. Here, the cantilevered support 1406T portion, and its associated arm cavity surface 1426T, extend outwardly from the trunk rest 1402 and further define the associated arm cavity surface 1426T. Similarly, the optional cantilevered support 1406H portion, and its associated arm cavity surface 1426H, further define the associated arm cavity surface 1426H. Here, the arm cavity 1408 along the "E" cross section is relatively large, and is configured to have sufficient room to accommodate comfortable movement of the person's upper arm.

Several points of novelty are apparent when FIGS. 14A-14E are considered in toto. In this exemplary embodiment, the arm aperture 1418 is generally configured in an arc, where the center of the arm aperture 1418 along the centerline is closest to the head rest 1404. The arc of the arm aperture 1418 results in the opposing ends of the arm aperture 1418 extending rearward towards the end surface 1436 of the trunk rest 1402. An unexpected benefit of this arc feature of the arm aperture 1418 is an increased level of comfort for the person when laying in the sleep-on-side position.

Also in this exemplary embodiment, the arm cavity 1408 is generally in an arc configuration. The effect of the arc configuration of the arm cavity 1408 is to provide additional room for movement of the person's lower arm and hand when laying in the sleep-on-side position (as contrasted with an embodiment where there is no arc). An unexpected benefit of this arc feature of the arm cavity 1408 is an increased level of comfort for the person when laying in the sleep-on-side position.

Since the height of the unibody contoured sleep system 1400 near the center of the arc of the arm aperture 1418 is greater than the height near the ends of the arm aperture 1418, a greater amount of support is provided to the person's trunk so as to provide an increased level of comfort for the person when laying in the sleep-on-side position.

It is appreciated that the arm aperture 1418 and/or the arm cavity 1408 may have different shapes and/or configurations to enhance comfort of the person when laying in the sleep-on-side position. Further, the dimensions of the arc or other configuration may be different with respect to the arm cavity surfaces 1426D and 1426H.

Depending upon the embodiment, the gradual, curving and inward sloping of the arm cavity surface 1426H from the trunk rest surface 1412 down to the bottom surface 1420 may vary. Accordingly, the overall design of the unibody contoured sleep system 1400 may vary upon specific dimensions, weight, physical characteristics, medical conditions, and/or other needs of a particular person. Particular embodiments may be custom fabricated for individuals to meet their particular sleeping requirements and/or medical conditions.

A single person unibody contoured sleep system 1400 may be configured to support a single person. A single person embodiment may be placed on a larger bed such that the person and a second person may sleep together, where the second person is not using the sleep system embodiment. The single person embodiment may be configured to fit any suitable mattress frame size, or may be configured to fit a portion of a suitable mattress size. Accordingly, a second conventional mattress may be placed adjacent to the single user embodiment to form a bed for two persons, thereby accommodating the second person.

In some embodiments, a two person unibody contoured sleep system 1400 may be configured to support two persons, each laying next to each other in the sleep-on-side position. The two person embodiment may be placed on a relatively larger bed, mattress, or bed frame such that the two persons may sleep together and both use the arm cavity 1408. In an exemplary embodiment, a single arm aperture 1418 may be provided that both persons use. In another exemplary embodiment, two arm apertures 1418 may used so that each person has their own arm aperture 1418. Further, a single arm cavity 1408 may be provided, or two separate arm cavities 1408 may be provided.

Figure 15:
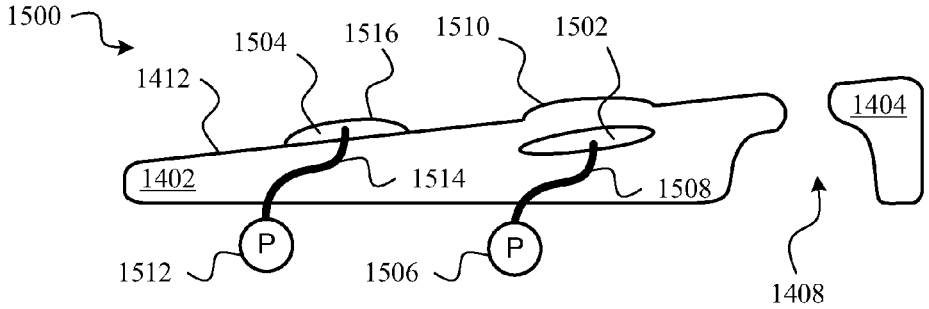
FIG. 15 shows an embodiment of the contoured sleep system with a plurality of adjustable support elements.

FIG. 15 shows an embodiment 1500 of the contoured sleep system with adjustable support elements 1502 and/or 1504. The adjustable support element 1502 is internal to the trunk rest 1402 and is in fluid communication with a pump 1506 via a tube 1508. A suitable fluid, such as air, water, or the like, may be added into the adjustable support element 1502 through actuation of the pump 1506. As the fluid is added to inflate the adjustable support element 1502, a perceived firmness of the trunk rest 1402 about the adjustable support element 1502 increases and/or a surface portion 1510 rises so as to provide an increased level of comfort for the person when laying in the sleep-on-side position. The adjustable support element 1502 may be located at any suitable place in the trunk rest 1402, and may be of any suitable size. The fluid may be removed from the adjustable support element 1502 so as to deflate the adjustable support element 1502 and/or surface indentation. The fluid in the adjustable support element 1502 may be removed by actuation of the pump 1506 and/or may be removed via a release valve (not shown) so that the fluid returns to a suitable reservoir (not shown).

The adjustable support element 1504 is external to the trunk rest 1402 and is in fluid communication with a pump 1512 via a tube 1514. A suitable fluid, such as air, water, or the like, may be added into the adjustable support element 1504 thru actuation of the pump 1512. As the fluid is added to inflate the adjustable support element 1504, a surface portion 1516 of the adjustable support element 1504 rises so as to provide an increased level of comfort for the person when laying in the sleep-on-side position. The adjustable support element 1504 may be located at any suitable place on the trunk rest surface 1412, and may be of any suitable size, to increase comfort of the person. The fluid may be removed from the adjustable support element 1504 so as to deflate the adjustable support element 1504. The fluid in the adjustable support element 1504 may be removed by actuation of the pump 1512 and/or may be removed via a release valve (not shown) so that fluid returns to a suitable reservoir (not shown).

In some embodiments, a single pump may be used to inflate and/or deflate the internal adjustable support element 1502 and the external adjustable support element 1504. Additionally, or alternatively, multiple adjustable support elements 1502 and/or adjustable support elements 1504 may be used. Some embodiments may use the internal adjustable support element 1502 in the head rest 1404 and/or use the external adjustable support element 1504 on the head rest surface 1414. The number of, location of, and/or size of the adjustable support elements 1502, 1504 may vary upon specific dimensions, weight, physical characteristics, medical conditions, and/or other needs of a particular person. Particular embodiments may be custom fabricated for individuals to meet their particular sleeping requirements and/or medical conditions.

Figure 16:
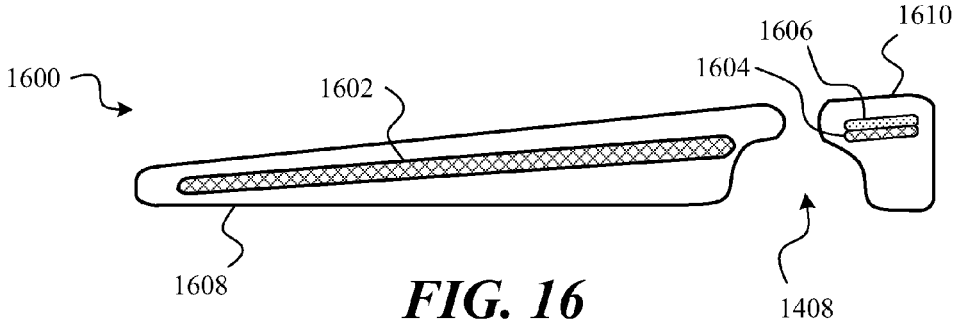
FIG. 16 shows an embodiment of the contoured sleep system with a plurality of internal support elements.

FIG. 16 shows an embodiment of the contoured sleep system 1600 with a plurality of internal support elements 1602, 1604, and/or 1606. The support element 1602 is internal to the trunk rest 1608. The support elements 1604 and 1606 are internal to the head rest 1610.

The relative densities of the material of the support elements 1602, 1604, and/or 1606 are different from the densities of the remainder material of the trunk rest 1608 and/or the head rest 1610. The densities of the support elements 1602, 1604, and/or 1606 may be greater than or less than the density of the remainder material of the trunk rest 1608 and/or the head rest 1610. Further, when two adjacent or substantially adjacent support elements are employed, such as the illustrated support elements 1604 and 1606, the densities may be different, their relative sizes may be different, and/or their relative locations with respect to each other may be different. Multiple support elements 1602 may be included in the trunk rest 1608. One or more of the support elements 1602, 1604, and/or 1606 may be used based upon specific dimensions, weight, physical characteristics, medical conditions, and/or other needs of a particular person. Particular embodiments may be custom fabricated for individuals to meet their particular sleeping requirements and/or medical conditions.

FIGS. 17A, 17B, and 17C illustrate various views of an exemplary two portion contoured sleep system 1700. The exemplary two portion contoured sleep system 1700 comprises a trunk rest 1702 and a head rest 1704. The head rest 1704 is configured with a base portion 1706 and two cantilevered support 1708 and 1710 portions. The two cantilevered supports 1708 and 1710 extend outwardly from the base portion 1706 and are separated from each other such that when each of the two cantilevered supports 1708 and 1710 are resting on a top edge 1712 of the trunk rest 1402, the two cantilevered supports 1708 and 1710 and the top edge 1712 cooperate to define an arm aperture 1714.

A cantilevered support 1715 at the head of the trunk rest 1702 defines a trunk rest cantilevered arm cavity surface 1716. The top edge 1712 is defined at the joining of the surface of the trunk rest 1702 and the trunk rest cantilevered arm cavity surface 1716. The trunk rest cantilevered arm cavity surface 1716 extends generally downward from the top edge 1712 and extends inward towards the bottom surface of the trunk rest 1702.

The lower side of the two cantilevered supports 1708 and 1710 each include a head rest cantilevered arm cavity surface 1718. When the two cantilevered supports 1708 and 1710 are resting on and are supported by the top edge 1712, the trunk rest cantilevered arm cavity surface 1716 and the two head rest cantilevered arm cavity surfaces 1718, cooperate to define an arm cavity 1720 that is configured to receive the person's arm when laying in the sleep-on-side position.

In an exemplary embodiment, a lower edge 1722 is defined at the joining of the bottom surface of the trunk rest 1702 with the trunk rest cantilevered arm cavity surface 1716. The lower edge 1722 is generally configured in an arc centered abut the centerline of the trunk rest 1702 and extending backwards towards the end of the trunk rest 1702. The arc of the lower edge 1722 results in the opposing ends of the arm cavity 1720 extending generally in a backwards direction towards the end of the trunk rest 1702. An unexpected benefit of this arc feature of the arm cavity 1720 is an increased level of comfort for the person when laying in the sleep-on-side position.

In the exemplary embodiment of the two portion contoured sleep system 1700, a width of the trunk rest 1702 is substantially greater than a width of the head rest 1704. Thus, the head rest 1704 is relatively small and may be easily adjusted by the person for their comfort. In other embodiments, the width of the trunk rest 1702 may be the same, or substantially the same, as the width of the head rest 1704.

FIG. 17A shows two cross sectional views 17B-17B' and 17C-17C' (corresponding to FIGS. 17B and 17C, respectively) of the two portion contoured sleep system 1700. The cross sectional view 17B-17B' corresponds to a central portion 1724 generally located near the central line of the exemplary unibody contoured sleep system 1700. The cross sectional view 17C-17C' corresponds to an interior portion 1726 generally located along the cantilevered portion 1708.

More specifically, FIG. 17B shows the cross sectional view 1728 (corresponding to the central portion 1724 indicated by the illustrated section line 17B-17B' in FIG. 17A, the "B" cross section). An end surface 1730 at the end of the trunk rest 1702 defines an end of the exemplary two portion contoured sleep system 1700. An end surface 1732 at the head of the head rest 1704 defines an opposing end of the exemplary two portion contoured sleep system 1700. The distance between the end surfaces 1730 and 1732 generally define the length of the exemplary two portion contoured sleep system 1700.

In this exemplary embodiment, a height of the end surface 1730 is substantially less than the height of the opposing end surface 1732. Accordingly, a trunk rest surface 1734 and a head rest surface 1736 are generally oriented along a gentle incline. In the various embodiments, the relative heights of the end surfaces 1730 and 1732 may vary so as to provide differing levels of incline. In one embodiment, the relative heights of the end surfaces 1730 and 1732 are the same such that there is no incline.

A trunk bottom surface 1738 defines the lower extent of the trunk rest 1702. A head rest bottom surface 1740 defines the lower extent of the head rest 1704. In some embodiments, the length of the two portion contoured sleep system 1700 corresponds to a prior art mattress or other surface. Thus, the bottom surfaces 1738 and 1740 can rest on top of the prior art mattress or other surface such as a topper, platform, or the like.

FIG. 17C shows the cross sectional view 1742 (corresponding to the interior portion 1726 indicated by the illustrated section line 17C-17C' in FIG. 17A, the "C" cross section) of the exemplary two portion contoured sleep system 1700. Here, the cantilevered support 1710 is supported by the trunk rest 1702 where the head rest cantilevered arm cavity surface portion 1718 is in contact with the top edge 1712 of the trunk rest 1702. Further, a material of the head rest cantilevered arm cavity surface 1718 about the region of contact with the top edge 1712 (and/or a portion of the material about the top edge 1712) may be made of a substantially non-slip material so that when the person has positioned and oriented the head rest 1704 as desired, the head rest 1704 remains in its position and orientation through the night.

FIGS. 18A, 18B, and 18C illustrate views of various alternative embodiments of the two portion contoured sleep systems 1800A, 1800B, and 1800C, respectively. The exemplary two portion contoured sleep systems 1800A, 1800B, and 1800C comprise the illustrated trunk rest 1802A, 1802B, and 1802C, respectively, and the above-described head rest 1704 (not shown).

The trunk rest 1800A portion is defined by a plurality of side walls 1804, 1806, and 1808, and an end wall 1810. The opposing side walls 1804 are substantially parallel. The two opposing side walls 1806 are tapered inward so that the lower part of the trunk rest 1800A is tapered. The side walls 1808, which align with straight the top edge 1712, are rounded or otherwise curved. The end wall 1810 defines the rear extent of the trunk rest 1800A.

An optional cutout region 1812 is provided on the surface of the two portion contoured sleep system 1800A. The cutout region 1812 receives the shoulder and/or armpit of the sleeping person. The cutout region 1812 may be included on other alternative embodiments.

In FIG. 18B, the opposing side walls 1814 and the top edge 1712 are rounded. In FIG. 18C, the opposing side walls 1816 and the top edge 1712 are straight. However, the opposing side walls 1814 angle outwards from the top edge 1712 to join with the corresponding opposing side walls 1804. The two portion contoured sleep systems 1800B and 1800C are not tapered. In alternative embodiments, the rear portions of the trunk rest 1802B, 1802C may be tapered.

The two portion contoured sleep systems 1800A, 1800B, and 1800C illustrate possible variations of the form of the trunk rest 1802A, 1802B, and 1802C, respectively. It is appreciated that the side walls of a trunk rest may be designed to any suitable shape. The shape may be decorative or serve a particular function which enhances the comfort of a sleeping person. For example, but not limited to, alternative end walls 1810 may be rounded, tapered, or the like in alternative embodiments.

FIG. 19 is a side view of the two portion contoured sleep system embodiment 1700 illustrating position adjustment of the head rest 1704. When the head rest 1704 is in a first position 1902, the head rest surface 1736 is oriented in a generally horizontal position. However, the person may be more comfortable if the head rest surface 1736 is oriented in a slope as illustrated by the head rest 1704 oriented in a second position 1904. Changes in the orientation of the head rest surface 1736 may be effected by moving and/or tilting the head rest 1704 in any desired position and/or orientation.

FIG. 20 shows an embodiment of the unibody contoured sleep system 1400 (FIGS. 14A-14E) with a plurality of trunk and head rest riser bodies 2002, 2004, 2006 located beneath the trunk rest 1402 and the head rest 1404. The trunk and head rest riser bodies 2002, 2004, 2006 increase the arm cavity vertical extent (V) to an increased arm cavity vertical extent (V'). Each of the trunk and head rest riser bodies 2002, 2004, 2006 are defined by a top surface 2008, a bottom surface 2010, a first end surface 2012 (associated with the trunk rest 1402), and a second end surface 2014 (associated with the head rest 1404). The width of the trunk and head rest riser bodies 2002, 2004, 2006 may be the same as, or may be different than, a width of the trunk rest 1702 and/or head rest 1704. Further, the trunk and head rest riser bodies 2002, 2004, 2006 may have the same shape as the unibody contoured sleep system 1400. For example, if the unibody contoured sleep system 1400 is tapered at one end, the trunk and head rest riser bodies 2002, 2004, 2006 may also be optionally tapered.

Each of the trunk and head rest riser bodies 2002, 2004, 2006 have an aperture disposed therethrough. The aperture of the trunk and head rest riser bodies 2002, 2004, 2006 generally corresponds to the shape and size of the bottom of the arm cavity 1408. Also, the aperture is oriented substantially below the arm cavity 1408. Accordingly, the person's lower arm can be comfortably oriented and positioned within the arm cavity 1408 having the increased arm cavity vertical extent (V').

For example, the arm cavity vertical extent of one embodiment may be ideal for a medium build person while sleeping. That is, the size of the arm cavity 1408 accommodates the medium build person's arm such that their upper arm comfortably extends downward and their upper arm rests comfortably in a substantially horizontal orientation. In contrast, a relatively larger build person when using the same embodiment, because of their longer arm, may not be able to have their upper arm comfortably extending downward and their upper arm resting comfortably in a substantially horizontal orientation. That is, the relatively larger person requires a relatively larger arm cavity vertical extent to be able to comfortably sleep. Accordingly, one or more or the trunk and head rest riser bodies 2002, 2004, 2006 may be used to increase the arm cavity vertical extent.

The top surface 2008 and the bottom surface 2010 of the first trunk and head rest riser body 2002 are parallel and are oriented substantially horizontal, resulting in a riser body that increases the arm cavity vertical extent without changing the slope of the trunk rest surface 1412. Any suitable thickness of the first trunk and head rest riser body 2002 may be used. Multiple trunk and head rest riser bodies 2002, of the same or different thicknesses, may be used to achieve a desired change in the arm cavity vertical extent.

The top surface 2008 and the bottom surface 2010 of the second trunk and head rest riser body 2004 are inclined with respect to each other, resulting in a wedge shaped configuration. The bottom surface 2010 is oriented substantially horizontal and the top surface 2008 inclines upwardly from the end surface 2014 to the end surface 2012. Accordingly, the second trunk and head rest riser body 2004 has a riser body that increases the arm cavity vertical extent, and that decreases the slope of the trunk rest surface 1412 and the head rest surface 1414. Any suitable thickness of the second trunk and head rest riser body 2004 may be used. Multiple trunk and head rest riser bodies 2004, of the same or different thicknesses, may be used to achieve a desired change in the arm cavity vertical extent and/or a change in slope of the trunk rest surface 1412 and the head rest surface 1414.

The top surface 2008 and the bottom surface 2010 of the third trunk and head rest riser body 2006 are inclined with respect to each other, resulting in a reverse wedge shaped configuration. The bottom surface 2010 is oriented substantially horizontal and the top surface 2008 inclines upwardly from the end surface 2012 to the end surface 2014. Accordingly, the third trunk and head rest riser body 2006 has a riser body that increases the arm cavity vertical extent, and that increases the slope of the trunk rest surface 1412 and the head rest surface 1414. Any suitable thickness of the third trunk and head rest riser body 2006 may be used. Multiple trunk and head rest riser bodies 2006, of the same or different thicknesses, may be used to achieve a desired change in the arm cavity vertical extent and/or a change in slope of the trunk rest surface 1412 and the head rest surface 1414.

It is appreciated that one or more of the second trunk and head rest riser bodies 2004 may be used in combination with one or more of the third trunk and head rest riser bodies 2006 to achieve any desired change in the slope of the trunk rest surface 1412 and head rest surface 1414.

The trunk and head rest riser bodies 2002, 2004, 2006 may be formed of any suitable material. Also, the densities of the trunk and head rest riser bodies 2002, 2004, 2006 may be more than, or may be less than, the density of the trunk rest 1402 and/or the head rest 1404. Furthermore, the densities of the trunk and head rest riser bodies 2002, 2004, 2006 may be different from each other. Additionally, the top surface 2008 and the bottom surface 2010 may be made of, or covered by, a slip resistant material such that the trunk and head rest riser bodies 2002, 2004, 2006 remained in a fixed position with respect to the trunk rest 1402 and the head rest 1404 while being used by the sleeping person. Alternatively, or additionally, the trunk and head rest riser bodies 2002, 2004, 2006 may be enclosed together, or enclosed with the trunk rest 1402 and the head rest 1404, using a fitted sheet, sack or other suitable fabric container.

Alternative embodiments of the trunk and head rest riser bodies 2002, 2004, 2006 may be configured to raise or lower the arm cavity vertical extent of the two portion contoured sleep system 1700 (FIGS. 17A-17C and 18A-18C). Also, the slope of the trunk rest surface 1734 and/or the head rest surface 1736 may be adjusted using the alternative embodiments of the trunk and head rest riser bodies 2002, 2004, 2006. In some embodiments, the distance between end surfaces 2012, 2014 may be defined to correspond to the trunk rest 1702 and/or the head rest 1704 of the two portion contoured sleep system 1700. For example, the distance between the end surfaces 2012, 2014 may correspond to a length of the trunk rest 1702 and its associated cantilevered support 1708.

Figure 21:
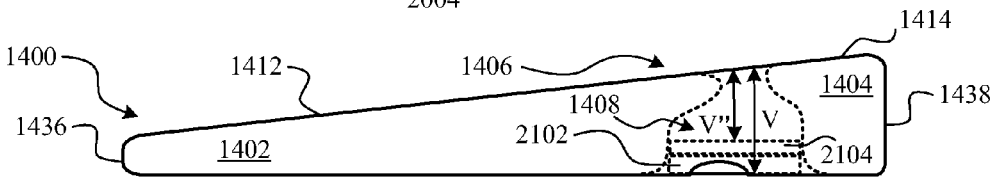

FIG. 21 shows an embodiment of the contoured sleep system 1400 (FIGS. 14A-14E) with a plurality arm cavity riser bodies 2012, 2014 that reduce the arm cavity vertical extent (V). The arm cavity riser bodies 2012, 2014 may also be configured for use with embodiments of the two portion contoured sleep system 1700 (FIGS. 17A-17C and 18A-18C).

The arm cavity riser bodies 2012, 2014 are generally shaped and sized to fit within the arm cavity 1408, thus resulting in a reduced arm cavity vertical extent (V"). The top and bottom surfaces of the arm cavity riser bodies 2012, 2014 are parallel and are oriented substantially horizontal. In alternative embodiments, the surfaces may be inclined.

Any suitable thickness may be selected for the arm cavity riser bodies 2012, 2014. Further, any suitable density of the material used to form the arm cavity riser bodies 2012, 2014 may be used.

The arm cavity riser bodies 2012, 2014 may be used so that the person's lower arm can be more comfortably oriented and positioned within the arm cavity 1408 having the arm cavity reduced vertical extent (V"). For example, the arm cavity vertical extent of one embodiment may be ideal for a medium build person while sleeping. In contrast, a relatively smaller build person when using the same embodiment, because of their shorter arm, may not be able to have their upper arm resting comfortably in a substantially horizontal orientation. That is, the relatively smaller person requires a relatively smaller arm cavity vertical extent to be able to comfortably sleep. Accordingly, one or more or the arm cavity riser bodies 2012, 2014 may be used to increase the arm cavity vertical extent.

FIGS. 22A-22B show an exemplary sheet, mattress pad, or other enclosure, generally denoted as a cover 2200, configured for use with embodiments of the unibody contoured sleep system 1400. It is appreciated that conventional fitted sheets and/or mattress pads may not be suitable for use with various embodiments of the unibody contoured sleep system 1400. FIG. 22A illustrates a cross section view generally corresponding to the center line of the unibody contoured sleep system 1400. FIG. 22B shows a top view of the exemplary sheet, mattress pad, or other enclosure deployed over the unibody contoured sleep system.

The cover 2200 comprises an upper cover 2202 and a lower cover 2204. The ends of the upper cover 2202 may be snuggly fitted around the end surface 1730 and/or 1732. Additionally, or optionally, the ends of the lower cover 2204 may be snuggly fitted around the end surface 1730 and/or 1732.

As illustrated in FIG. 22A, the upper cover 2202 and the lower cover 2204 are configured to come together in an upper region of the arm cavity 1408. Accordingly, a portion 2206 of the upper cover 2202 is affixed to a corresponding portion 2208 of the lower cover 2204. The portions 2206 and 2208 may be sewn together so that the upper cover 2202 and the lower cover 2204 are permanently secured together. Alternatively, other suitable fasteners, such as buttons, snaps, Velcro, zippers, straps or the like, may be used to secure the upper cover 2202 to the lower cover 2204.

An aperture 2210 is disposed in the upper cover 2202 and the lower cover 2204 in the respective portions 2206, 2208. In an exemplary embodiment, the aperture substantially corresponds to the shape and size of the arm aperture 1418, as is illustrated in FIG. 22B. Accordingly, the person may extend their lower arm through the aperture 2210 while sleeping.

The ends of the upper cover 2202 and the lower cover 2204 are not permanently fastened together (although they may be temporarily fastened during use with buttons, snaps, Velcro, zippers, straps or the like). Thus, the person may easily remove the cover 2200 for cleaning, storage, or the like.

In an exemplary embodiment, the cover 2200 may be fabricated by placing a first sheet 2202 over the bottom of the unibody contoured sleep system 1400, and by placing a second sheet 2204 over the top of the unibody contoured sleep system 1400 so that the top sheet 2202 encloses the bottom sheet 2204 and the unibody contoured sleep system 1400. Now, the two sheets 2202, 2204 are brought together at the regions 2208, 2208, respectively (which corresponds to the arm aperture 1418). The two sheets 2202, 2204 are then fastened by sewing them together in the shape of the arm aperture 1418 where they are in contact with each other. A mattress pad may also be added. The sheets 2202 and/or 2204 may be conventional flat sheets or fitted sheets.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention, in which an exclusive property or privilege is claimed, are defined as follows:

1. A sleep system with a head rest, the head rest comprising:

a base portion;

a first cantilevered support that extends outwardly from the base portion; and a second cantilevered support that extends outwardly from the base portion and is separated from the first cantilevered support, wherein the first cantilevered support and the second cantilevered support are configured to rest on and be supported by a top edge of a trunk rest configured to support a trunk of a person laying in a sleep-on-side position.

2. The sleep system of claim 1, wherein the first cantilevered support, the second cantilevered support, and the top edge of the trunk rest cooperate to define an arm aperture that is configured to receive an arm of the person laying in the sleep-on-side position.

3. The sleep system of claim 1, wherein the first cantilevered support defines a first head rest cantilevered arm cavity surface, wherein the second cantilevered support defines a second head rest cantilevered arm cavity surface, and wherein the first head rest cantilevered arm cavity surface, the second head rest cantilevered arm cavity surface, and the trunk rest cooperate to define an arm cavity that is configured to receive the arm of the person laying in the sleep-on-side position.

4. The sleep system of claim 1, wherein the trunk rest includes a lower edge defined at the joining of a trunk rest bottom surface with a trunk rest cantilevered arm cavity surface, and wherein the lower edge of the trunk rest is configured in an arc centered about a centerline of the trunk rest and extending backwards towards an end of the trunk rest.

5. The sleep system of claim 1, wherein the trunk rest includes a trunk rest end surface at an end of the trunk rest that defines an end of the sleep system, wherein the head rest further comprises:

a head rest end surface at an end of the head rest that defines a head of the sleep system, wherein a height of the head rest end surface is greater than a height of the trunk rest end surface such that the trunk rest surface is defined by a gentle incline from the head of the sleep system to the end of the sleep system.

6. The sleep system of claim 1, wherein the top edge of the trunk rest is defined as an arc centered about a centerline of the trunk rest and extending backwards towards an end of the trunk rest.

7. The sleep system of claim 1, wherein the trunk includes a cutout region on the trunk rest top surface that is centered about a centerline of the trunk rest and at the top edge, and wherein the cutout region is configured to receive a shoulder or armpit of the person laying in the sleep-on-side position.

8. The sleep system of claim 1, further comprising:

a riser body configured to be located beneath the trunk rest and the head rest, wherein the riser body is defined by an aperture extending therethrough, wherein the aperture is oriented substantially below an arm cavity, wherein the aperture is substantially the same shape and size as the arm cavity, and wherein the riser body is configured to increase an arm cavity vertical extent.

9. The sleep system of claim 8, wherein the riser body is defined by a top surface, a bottom surface, a first end surface corresponding to an end of the sleep system, and a second end surface corresponding to a head of the sleep system, and wherein the bottom surface of the riser body is parallel with the top surface of the riser body such that when the riser body is located beneath the trunk rest and the head rest, the riser body maintains a slope of the trunk rest top surface.

10. The sleep system of claim 8, wherein the riser body is defined by a top surface, a bottom surface, a first end surface corresponding to an end of the sleep system, and a second end surface corresponding to a head of the sleep system, and wherein a height of the first end surface of the riser body is less than a height of the second end surface of the riser body, such that when the riser body is located beneath the trunk rest and the head rest, the riser body increases a slope of the trunk rest top surface.

11. The sleep system of claim 8, wherein the riser body is defined by a top surface, a bottom surface, a first end surface corresponding to an end of the sleep system, and a second end surface corresponding to a head of the sleep system, and wherein a height of the first end surface of the riser body is greater than a height of the second end surface of the riser body, such that when the riser body is located beneath the trunk rest and the head rest, the riser body decreases a slope of the trunk rest top surface.

12. The sleep system of claim 1, further comprising:

an arm cavity riser body configured to be located inside an arm cavity, wherein the arm cavity riser body is configured to reduce an arm cavity vertical extent.

* * * * *